US011629943B2

(12) United States Patent
Langdon et al.

(10) Patent No.: US 11,629,943 B2
(45) Date of Patent: Apr. 18, 2023

(54) CROSSBOW HAVING TRIGGER MECHANISM WITH ARROW RETENTION

(71) Applicant: Excalibur Crossbow, Inc., Eugene, OR (US)

(72) Inventors: Stephen Langdon, Arthur (CA); Kyle Egerdee, Fergus (CA); Cole Jessup, Waterloo (CA)

(73) Assignee: EXCALIBUR CROSSBOW, LLC, Eugene, OR (US)

( * ) Notice: Subject to any disclaimer, the term of this patent is extended or adjusted under 35 U.S.C. 154(b) by 0 days.

(21) Appl. No.: 17/860,882

(22) Filed: Jul. 8, 2022

(65) Prior Publication Data

US 2022/0341717 A1 Oct. 27, 2022

Related U.S. Application Data

(60) Division of application No. 17/182,144, filed on Feb. 22, 2021, now Pat. No. 11,385,033, which is a (Continued)

(51) Int. Cl.
*F41B 5/12* (2006.01)
*F42B 6/06* (2006.01)

(52) U.S. Cl.
CPC ..... *F42B 6/06* (2013.01); *F41B 5/123* (2013.01); *F41B 5/126* (2013.01)

(58) Field of Classification Search
CPC .... F41B 5/12; F41B 5/123; F41B 5/14; F41B 5/1403; F42B 6/04; F42B 6/06
(Continued)

(56) References Cited

U.S. PATENT DOCUMENTS 1,542,159 A * 6/1925 Maxwell ..... F41B 5/1469 124/31
1,866,926 A * 7/1932 Colby ..... F41B 5/12 124/22

(Continued)

OTHER PUBLICATIONS

Lacas Crossbows; "Homemade double crossbow 2×120 lbs"; May 30, 2015; video screenshots provided; video at https:1/youtu.be/qXMDXe_Cbvl.

(Continued)

*Primary Examiner* — Alexander R Niconovich
(74) *Attorney, Agent, or Firm* — Husch Blackwell LLP

(57) ABSTRACT

A nock for an archery arrow or bolt. The nock includes a radial indention configured to be engaged by a biased retainer of a trigger mechanism of a crossbow to retain the arrow or bolt in a desired position relative to the trigger mechanism and/or a bowstring. The radial indention may optionally comprise a groove defined generally continuously around a circumference of the nock. The radial indention is exposed when the nock is coupled with an arrow or bolt such that the radial indention may be engaged by a biased retainer within the trigger mechanism. The nock may further include a generally planar rearward bearing surface configured for being engaged by a bowstring. The nock of the present invention may be suitable for use with a multiple-shot crossbow or a single-shot crossbow. Other aspects of the present invention are directed to a projectile, a projectile retention system, and a crossbow.

18 Claims, 20 Drawing Sheets

Related U.S. Application Data continuation-in-part of application No. 16/835,249, filed on Mar. 30, 2020, now Pat. No. 11,143,482.

(58) Field of Classification Search
USPC ..... 124/25; 473/578
See application file for complete search history.

(56) References Cited

U.S. PATENT DOCUMENTS 2,484,589 A * 10/1949 Richards ..... F42B 6/06 D21/387
2,786,461 A 3/1957 Pelsue, Jr.
2,997,998 A 8/1961 Traise
3,043,287 A 7/1962 Nelson
3,214,174 A * 10/1965 Saunders ..... F42B 6/06 473/578
3,224,427 A * 12/1965 Ronan ..... F41B 5/12 124/35.1
3,561,419 A 2/1971 Cucuzza, Sr.
3,670,711 A 6/1972 Firestone
3,741,190 A 6/1973 Lopez
3,749,076 A * 7/1973 Suski ..... F41B 5/1469 124/31
3,788,299 A * 1/1974 Mathews ..... F41B 5/12 124/35.1
4,030,473 A * 6/1977 Puryear ..... F41B 5/1469 124/40
4,134,369 A * 1/1979 Cook ..... F41B 5/1415 124/91
4,151,825 A * 5/1979 Cook ..... F41B 5/1469 124/40
4,544,163 A 10/1985 Scanlon
4,593,675 A 6/1986 Waiser
4,603,676 A 8/1986 Luoma
4,649,892 A 3/1987 Bozek
4,656,994 A * 4/1987 Jenks ..... F41G 1/467 124/90
4,697,571 A 10/1987 Waiser
4,719,897 A 1/1988 Gaudreau
4,722,318 A * 2/1988 Yankey ..... F41B 5/123 124/44.5
4,942,861 A 7/1990 Bozek
4,947,822 A * 8/1990 Jones ..... F41B 5/12 124/25
4,958,617 A * 9/1990 Anderson ..... F41B 5/143 124/44.5
5,085,200 A * 2/1992 Horton-Corcoran ..... F41B 5/1469 124/40
5,115,795 A 5/1992 Farris
5,154,432 A 10/1992 Saunders
5,220,906 A 6/1993 Choma
5,306,019 A 4/1994 Guest et al.
5,372,118 A 12/1994 Schmidt, III et al.
5,437,260 A 8/1995 King
5,439,231 A * 8/1995 Roberts ..... F42B 6/06 124/31
5,465,979 A 11/1995 Buhler
5,598,829 A 2/1997 Bednar
5,649,520 A 7/1997 Bednar
5,649,521 A 7/1997 King
5,803,843 A 9/1998 Anderson et al.
5,823,172 A 10/1998 Suggitt
5,884,614 A * 3/1999 Darlington ..... F41B 5/12 124/35.1
6,095,128 A 8/2000 Bednar
6,205,990 B1 3/2001 Adkins
6,286,496 B1 9/2001 Bednar
6,708,683 B1 3/2004 Harris
6,736,123 B1 5/2004 Summers et al.
6,799,566 B1 10/2004 Malucelli
6,802,304 B1 10/2004 Chang
6,868,845 B1 * 3/2005 Moore ..... F41B 5/10 124/25
6,913,007 B2 7/2005 Bednar
6,953,034 B2 10/2005 May et al.
7,100,590 B2 9/2006 Chang
7,455,059 B2 * 11/2008 Shaffer ..... F41B 5/1426 124/25
7,588,022 B2 * 9/2009 Chang ..... F41B 5/123 124/40
7,770,567 B1 8/2010 Yehle
7,784,453 B1 8/2010 Yehle
7,922,609 B1 4/2011 Hajari
8,061,339 B2 * 11/2011 Shaffer ..... F41B 5/1426 124/25
8,091,540 B2 1/2012 Matasic et al.
8,104,461 B2 1/2012 Kempf
8,240,299 B2 8/2012 Kronengold et al.
8,382,616 B2 2/2013 Marshall
8,443,790 B2 5/2013 Pestrue
8,453,631 B1 6/2013 Kronengold et al.
8,499,753 B2 8/2013 Bednar et al.
8,578,917 B2 11/2013 Bednar et al.
8,622,855 B2 1/2014 Bednar et al.
8,662,061 B1 * 3/2014 Darlington ..... F41B 5/12 124/44.5
8,845,464 B1 9/2014 Hyde
8,857,420 B2 * 10/2014 Grace ..... F41B 5/12 124/25
8,899,217 B2 12/2014 Islas
8,931,465 B1 * 1/2015 Choma ..... F41B 5/12 124/40
8,950,385 B1 2/2015 Khoshnood
8,978,634 B2 * 3/2015 Darlington ..... F41B 5/143 124/25
9,010,308 B1 4/2015 Hyde et al.
9,028,347 B2 5/2015 Pedersen
9,074,837 B2 7/2015 Bednar et al.
9,140,516 B1 9/2015 Hyde
9,255,754 B1 2/2016 Kempf
9,255,755 B1 * 2/2016 Barnett ..... F41B 5/14
9,303,944 B2 4/2016 Barber
9,341,432 B1 5/2016 Wohleb
9,341,434 B2 5/2016 McPherson et al.
9,383,159 B2 7/2016 Pulkrabek et al.
9,383,177 B1 7/2016 Kallmes
9,404,706 B2 8/2016 Khoshnood
9,417,029 B1 * 8/2016 Chang ..... F41B 5/1469
9,441,925 B1 * 9/2016 Palomaki ..... F42B 6/04
9,453,700 B2 9/2016 Bednar et al.
9,470,486 B2 10/2016 Bednar et al.
9,494,380 B1 * 11/2016 Yehle ..... F41A 17/46
9,506,715 B2 11/2016 Hughes
9,528,792 B1 12/2016 Chang
9,551,544 B1 1/2017 Kempf
9,557,134 B1 1/2017 Yehle
9,671,202 B2 6/2017 Brown
9,733,051 B2 8/2017 Bay
9,759,513 B2 9/2017 Bednar et al.
9,909,832 B2 3/2018 Darlington et al.
9,958,232 B1 5/2018 Egerdee et al.
10,012,468 B1 7/2018 Kempf et al.
10,030,948 B2 7/2018 Bednar et al.
10,119,796 B2 11/2018 Bednar et al.
10,203,187 B1 2/2019 Bay
10,209,027 B2 * 2/2019 Chu ..... F41B 5/12
10,234,251 B2 3/2019 Ans et al.
10,393,484 B2 8/2019 Bednar et al.
10,401,117 B1 * 9/2019 Rowzie, Jr. ..... F41A 19/06
10,508,884 B1 * 12/2019 Chen ..... F41A 17/46
10,883,806 B2 1/2021 Bednar et al.
11,105,592 B1 * 8/2021 Keeney ..... F42B 6/06
2002/0059924 A1 5/2002 Bednar
2004/0194771 A1 10/2004 Malucelli
2005/0022799 A1 2/2005 Bednar
2006/0086346 A1 4/2006 Middleton
2006/0144380 A1 7/2006 Kempf
2006/0169258 A1 8/2006 Chang
2007/0137630 A1 * 6/2007 Simo ..... F41B 5/1469 473/578
2010/0170488 A1 7/2010 Rasor et al.

(56) References Cited

U.S. PATENT DOCUMENTS

| | | | |
|---|---|---|---|
| 2012/0100942 | A1 | 4/2012 | Minica |
| 2013/0098343 | A1 | 4/2013 | Grace |
| 2014/0087896 | A1 | 3/2014 | Torkelson et al. |
| 2015/0105191 | A1 | 4/2015 | Pedersen et al. |
| 2018/0231359 | A1 | 8/2018 | Yehle et al. |
| 2019/0331453 | A1 | 10/2019 | Zou |
| 2020/0224993 | A1 | 7/2020 | Egerdee et al. |
| 2020/0292271 | A1 | 9/2020 | Williams |
| 2021/0123710 | A1 | 4/2021 | Bednar et al. |
| 2021/0164753 | A1 | 6/2021 | Williams |

OTHER PUBLICATIONS

Lacas Crossbows; "Homemade double crossbow making"; Nov. 22, 2015; video screenshots provided; video at https://youtu.be/Em1CrcPcWlo.

Lacas Crossbows; "Double crossbow 6 arrow shooting"; Dec. 29, 2018; video screenshots provided; video at https://youtu.be/FtpZvdkQXcM.

* cited by examiner

CROSSBOW HAVING TRIGGER MECHANISM WITH ARROW RETENTION

CROSS-REFERENCE TO RELATED APPLICATIONS

This application is a Divisional of and claims priority to U.S. patent application Ser. No. 17/182,144 filed Feb. 22, 2021, to Stephen Langdon et al., entitled "Rear Arrow Nock with Retention," currently pending, which is a Continuation-in-Part of and claims priority to U.S. patent application Ser. No. 16/835,249 filed Mar. 30, 2020, to Kyle William Egerdee et al., entitled "Multiple-Shot Crossbow," now issued U.S. Pat. No. 11,143,482. The entire disclosures of the foregoing, including the specifications and drawings, are incorporated herein by reference.

FIELD OF THE INVENTION

The present invention relates generally to archery equipment. More specifically, a nock is described herein that permits for improved positional retention of a nocked arrow or bolt and also permits multiple orientations an arrow or bolt relative to a bowstring.

BACKGROUND OF THE INVENTION

When handling a nocked crossbow, ensuring that the arrow or bolt is retained in its desired nocked position against the bowstring and relative to the trigger mechanism is key to ensuring the crossbow is ready to be shot when desired. Various movements, such as an inadvertent bump of the crossbow while it is being handled, can result in the arrow or bolt becoming dislodged or otherwise moved from its desired nocked position relative to the bowstring and/or trigger mechanism. When using a multiple-shot crossbow, such as that described in U.S. patent application Ser. No. 16/835,249, the movement or recoil associated with shooting a first arrow or bolt may be enough, depending on various circumstances, to move or shift a second or subsequent arrow or bolt such that it is displaced from a desired nocked position relative to the bowstring and/or trigger mechanism. If this occurs, a hang-fire scenario may occur where the second shot cannot be taken.

Various existing nocks contain a groove, slot, notch, channel, or the like, to capture a bowstring for purposes of retaining an arrow or bolt in a fixed position relative thereto. However, such existing nocks can be disadvantageous, because the notch, channel, or groove that captures the bowstring must be properly aligned during manufacture and use. Specifically, during manufacture, the notch, channel, or groove a capture nock must be properly aligned relative to the vanes, including the "cock vane," of the fletching of the arrow or bolt to ensure that the fletching does not contact or hit the crossbow, or any components thereof, including the riser, during use. For this reason, it is important that the notch, channel, or groove is properly aligned relative to the cock vane of the arrow or bolt during manufacture, and various technologies have attempted to address the difficulty of aligning the notch, channel, or groove with the cock vane during manufacture.

At the same time, during use, even if the notch, channel, or groove of the capture nock is properly aligned relative to the cock vane of the arrow or bolt, the nature of the notch, channel, or groove typically only allows the arrow or bolt to be indexed in one orientation relative to the crossbow. This can cause excessive wear of a particular circumferential segment of the arrow or bolt that is opposite of the cock vane and is more prone to and typically comes into contact with the crossbow, and any components thereof, during use. Such excessive wear of a particular circumferential segment of the arrow or bolt can unnecessarily shorten the useable life of the arrow or bolt, especially because a user cannot index the vanes of the arrow or the bolt in a way that more evenly spreads the wear over other circumferential segments of the arrow or bolt due to the limitations of the capture nock, including the notch, channel, or groove thereof.

SUMMARY

The present invention involves the provision of a nock having a radial indention configured to be engaged by a trigger mechanism such that a projectile (e.g., an archery arrow or archery bolt) may be retained in a desired position relative the trigger mechanism and/or a bowstring. In one embodiment, the nock comprises a body having a forward segment and a rearward segment, wherein the forward segment is configured for at least partially engaging a rear end portion of the projectile. The nock can further include at least one radial indention defined in the body. The radial indention can be configured to be engaged by a component of a crossbow in order to retain the projectile in position. More specifically, the radial indention can be engaged by a biased projectile retainer of a crossbow trigger mechanism. The radial indention may be at least partially defined by the rearward segment or may defined entirely within the rearward segment. In one embodiment, the radial indention comprises a groove defined generally continuously around a circumference of the nock body. In another embodiment, the radial indention comprises a plurality of grooves defined generally intermittently around the circumference of the nock body. In a further embodiment, the radial indention includes only a single indention defined within a single location of the nock body.

In one embodiment, the rearward segment of the nock may include a generally planar rearward bearing surface that is generally perpendicular to a longitudinal axis of the nock. It will be understood that in some embodiments, the rearward segment of the nock does not include any grooves, slots, notches, channels, concave indentions, impressions, arms, or the like designed to wholly or partially receive or capture a bowstring.

In one embodiment, the forward and the rearward segment of the nock are integrally formed together as a unitary structure. The two segments may be formed of a single piece of material that is molded, machined, milled, and/or turned on a lathe, for example. The nock can include a shoulder projecting radially outwardly relative to the forward, wherein the shoulder is configured for indexing the nock longitudinally relative to the rear end portion of the projectile. The shoulder may bifurcate the body of the nock between the forward segment and the rearward segment. It will be appreciated that the forward segment can define a first outer diameter, the rearward segment can define a second outer diameter, and that the first diameter may be smaller than the second diameter. In one embodiment, the rearward segment of the nock comprises an internally threaded bore that may be engaged by a tool, such as a pulling device.

The present invention also involves the provision of a projectile having a nock. As further explained herein, a projectile may include an archery arrow, an archery bolt, or any other elongated object suitable for shooting from a crossbow. The projection can include a shaft having a front end portion, a rear end portion, and a longitudinal axis defined and extending therethrough. It will be understood that the projectile may be positionable in a wide range of rotational positions. The projectile may include a nock, such as the nock described above.

An additional aspect of the present invention involves the provision of a projectile retention system that includes a nock, such as the one generally described above, in combination with a trigger mechanism. The trigger mechanism is configured to engage the nock. More specifically, one embodiment of the trigger mechanism includes a biased projectile retainer positioned and arranged so that, with a projectile present, the biased projectile retainer engages the radial indention of the nock to retain the projectile in a position relative to the trigger mechanism and/or a bowstring.

A further aspect of the present invention involves the provision of a crossbow system that includes a trigger mechanism configured for engaging the radial indention of an arrow nock as described herein.

Objects and advantages pertaining to the nock for arrows or bolts may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In the accompanying drawings, which form a part of the specification and are to be read in conjunction therewith in which like reference numerals are used to indicate like or similar parts in the various views.

Figure 1:
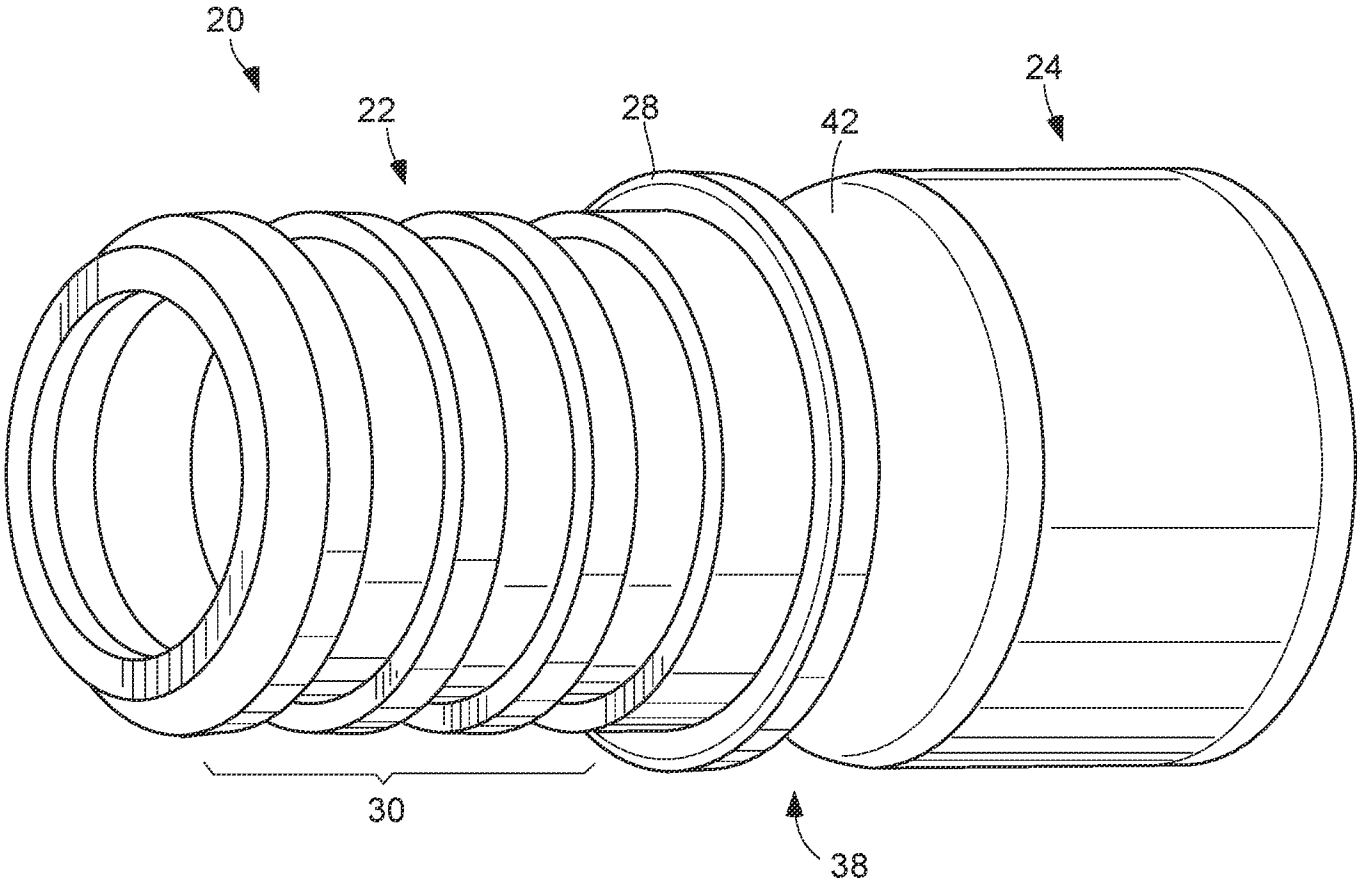
FIG. 1 is a first perspective view of an example nock for an arrow or bolt for a crossbow.

The embodiments depicted are shown only schematically; all features may not be shown in full detail or in proper proportion; for clarity certain features or structures may be exaggerated or diminished relative to others or omitted entirely; the drawings should not be regarded as being to scale unless explicitly indicated as being to scale. The embodiments shown are only examples and should not be construed as limiting the scope of the present disclosure or appended claims.

DETAILED DESCRIPTION OF EMBODIMENTS

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized, and changes can be made without departing from the scope of the present invention.

In the following description and claims, the terms "upper" and "lower" are used to denote various elements of the present technology. However, when referring to portions of the mainframe, the riser, the bow limbs, and the bowstrings, those terms typically are both spatial as well as functional, e.g., with the crossbow held in its usual orientation for launching a bolt, the upper rail is above the lower rail, the upper bowstring is above the lower bowstring, and so on. At the same time, when referring to the trigger mechanism and its various constituent elements, those terms are functional but not necessarily spatial, e.g., the upper string catch can be above the lower string catch, but the upper trigger actuator (which can be coupled functionally to the upper sear and upper string catch to release the drawn upper bowstring and launch a bolt from the upper rail) is not necessarily above the lower trigger actuator (which can be coupled functionally to the lower sear and lower string catch to release the drawn lower bowstring and launch a bolt from the lower rail). Furthermore, in the following description and claims, the term "projectile" may be used in referring to an archery arrow, an archery bolt, or any other elongated object suitable for shooting from a crossbow. It will be appreciated that concepts within the description and claims may apply equally to both arrows and bolts and that, in such cases, the terms "arrows" and "bolts" may be used interchangeably throughout the disclosure.

Figure 2:
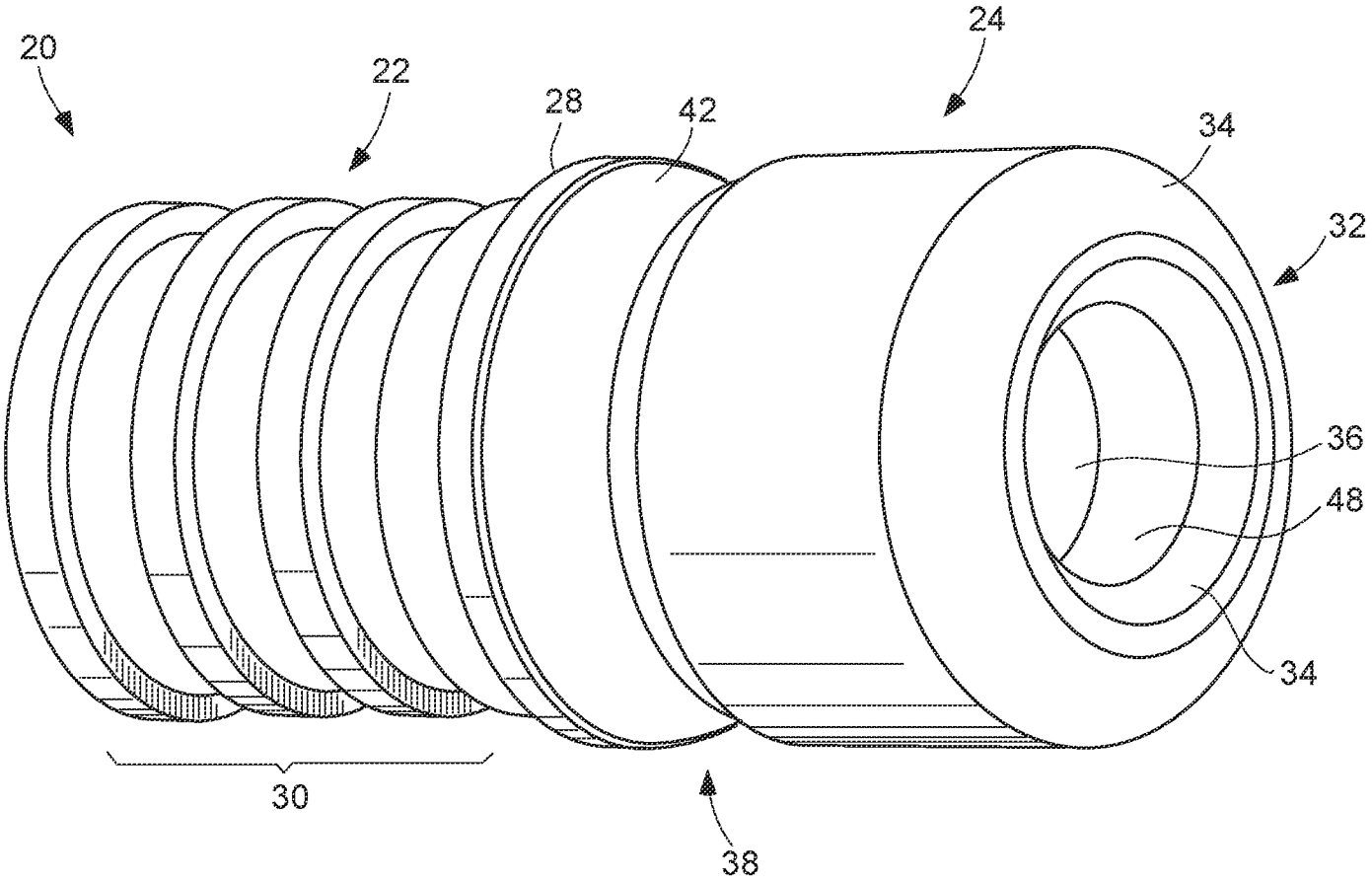
FIG. 2 is a second perspective view of the example nock of FIG. 1.
Figure 3:
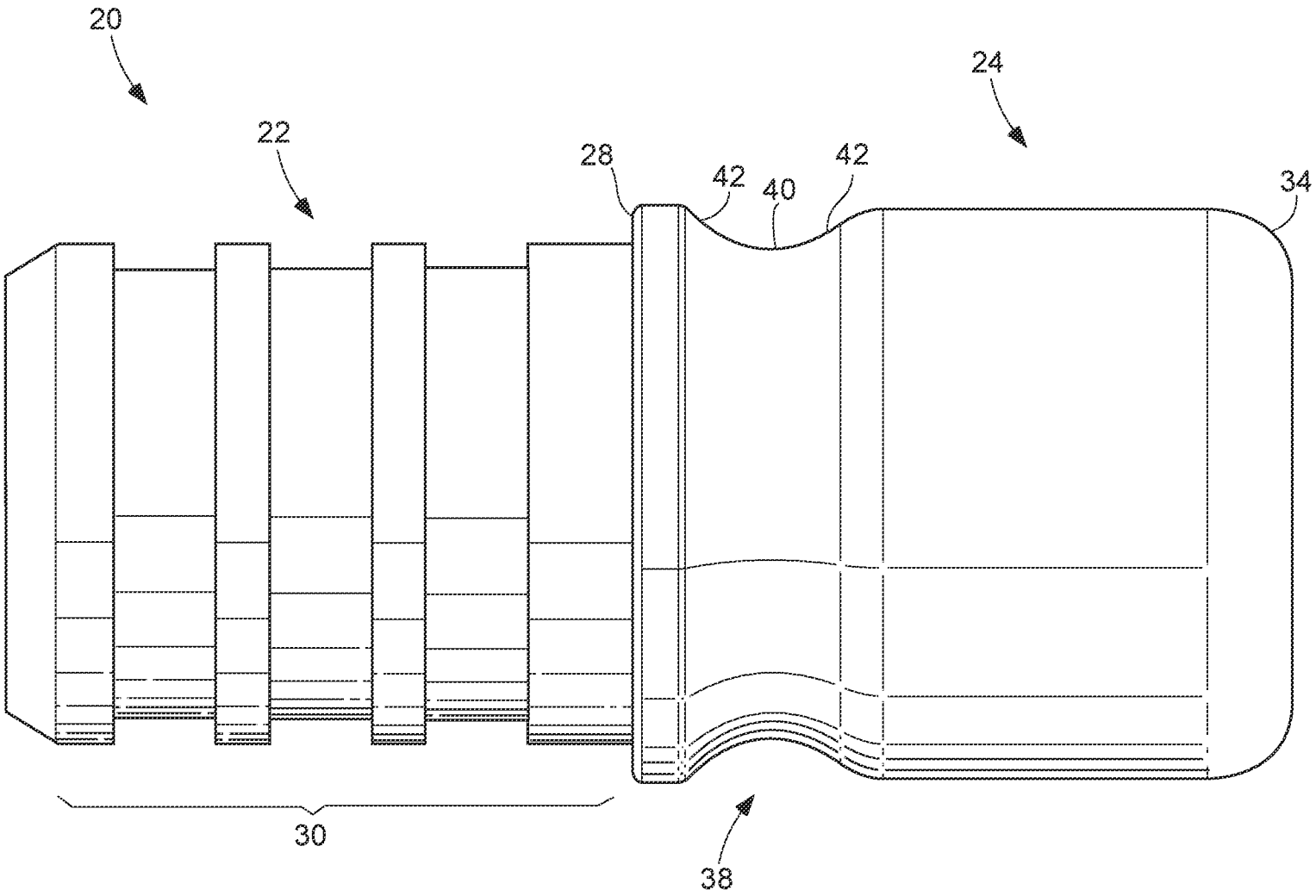
FIG. 3 is a side view of the example nock of FIG. 1.

An example of an inventive nock 20 is shown in FIGS. 1-3. The nock 20 may comprise a generally cylindrical forward segment 22 and a generally cylindrical rearward segment 24 that may be substantially concentric and aligned with a longitudinal axis of the nock 20. In one embodiment, the forward segment 22 defines an outer diameter that is smaller than an outer diameter defined by the rearward segment 24. A circumferential ledge or shoulder 28 can be provided, as part of the forward segment 22, the rearward segment 24, or an intermediate portion therebetween. The forward segment 22 and/or the rearward segment 24 can optionally be generally or entirely hollow or defined one or more cavities therein in order to reduce weight or to produce a nock 20 of a specified weight (i.e., a specific number of grains).

The nock 20 can be formed from a variety of materials, including a rigid material suitable for withstanding and transmitting the force from the impact of the bowstring 291/292 (as discussed in more detail below). Such materials include, without limitation, metals, plastics, composites, and combinations thereof. More specifically, aluminum, titanium, polycarbonate, acrylonitrile butadiene styrene (ABS), butyrate plastic, and any combination thereof, are nonlimiting examples of suitable lightweight materials. It will be appreciated that the nock 20 may be formed from one or more pieces and from one or more materials. For example, in an illuminated embodiment, the nock 20 may comprise two or more pieces that are assembled or connected together. In such an embodiment, at least a portion of the rearward segment 24 may be lit or otherwise illuminated. Various manufacturing techniques may be used in constructing the nock, including molding, machining, milling, turning on a lathe, or other suitable techniques, and combinations thereof.

Figure 4:
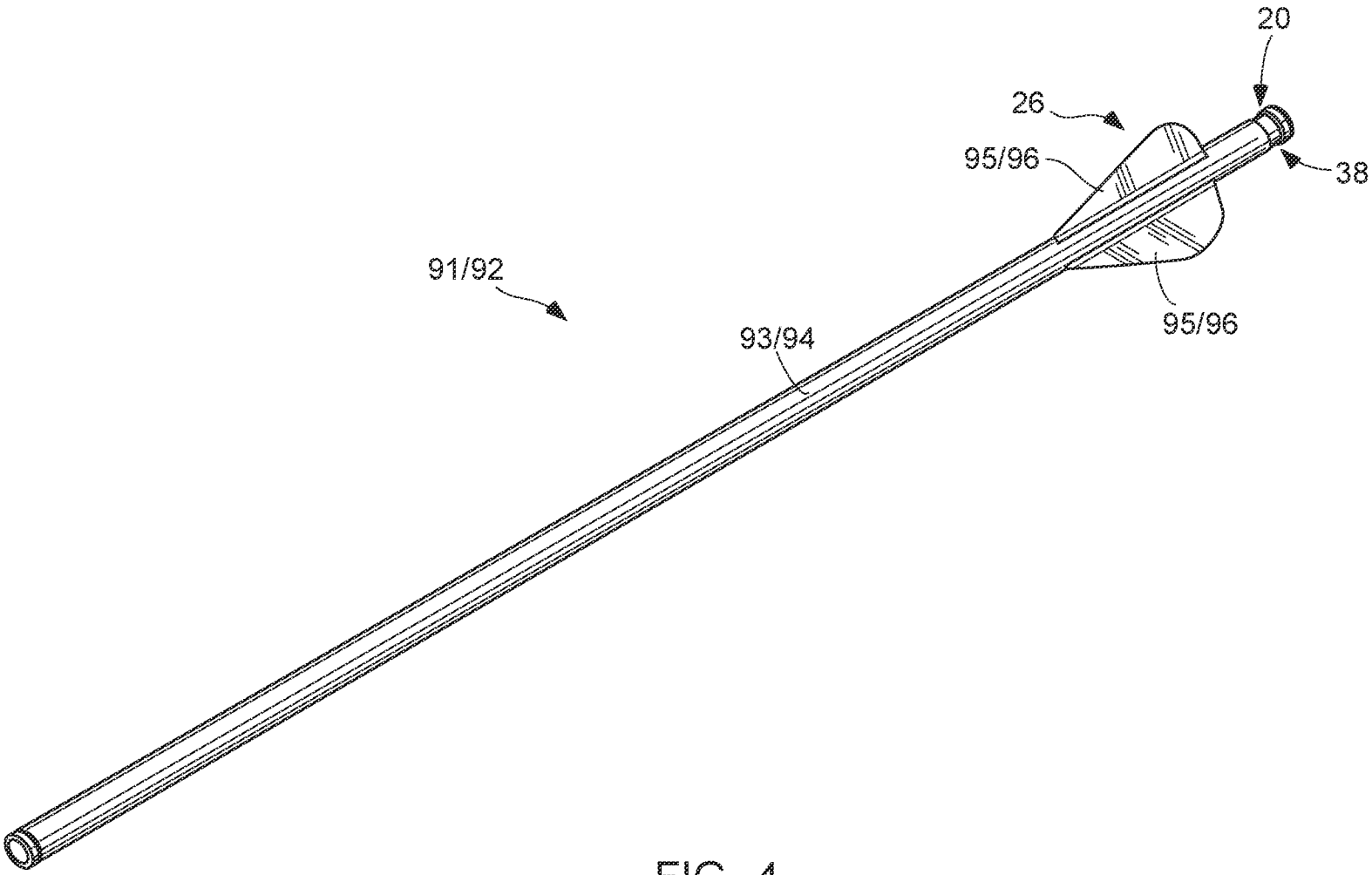
FIG. 4 is a perspective view of an example arrow or bolt for a crossbow.
Figure 5:
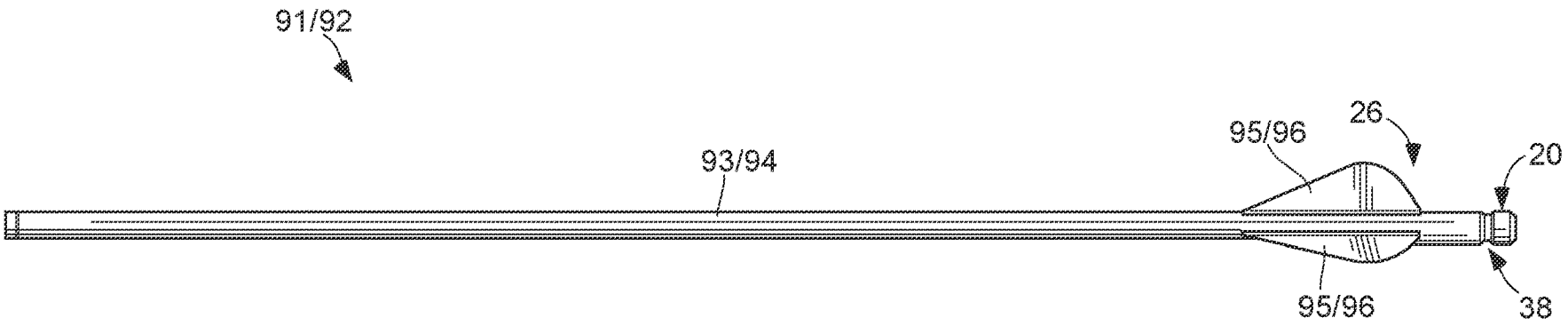
FIG. 5 is a side view of the example arrow or bolt of FIG. 4.
Figure 6:
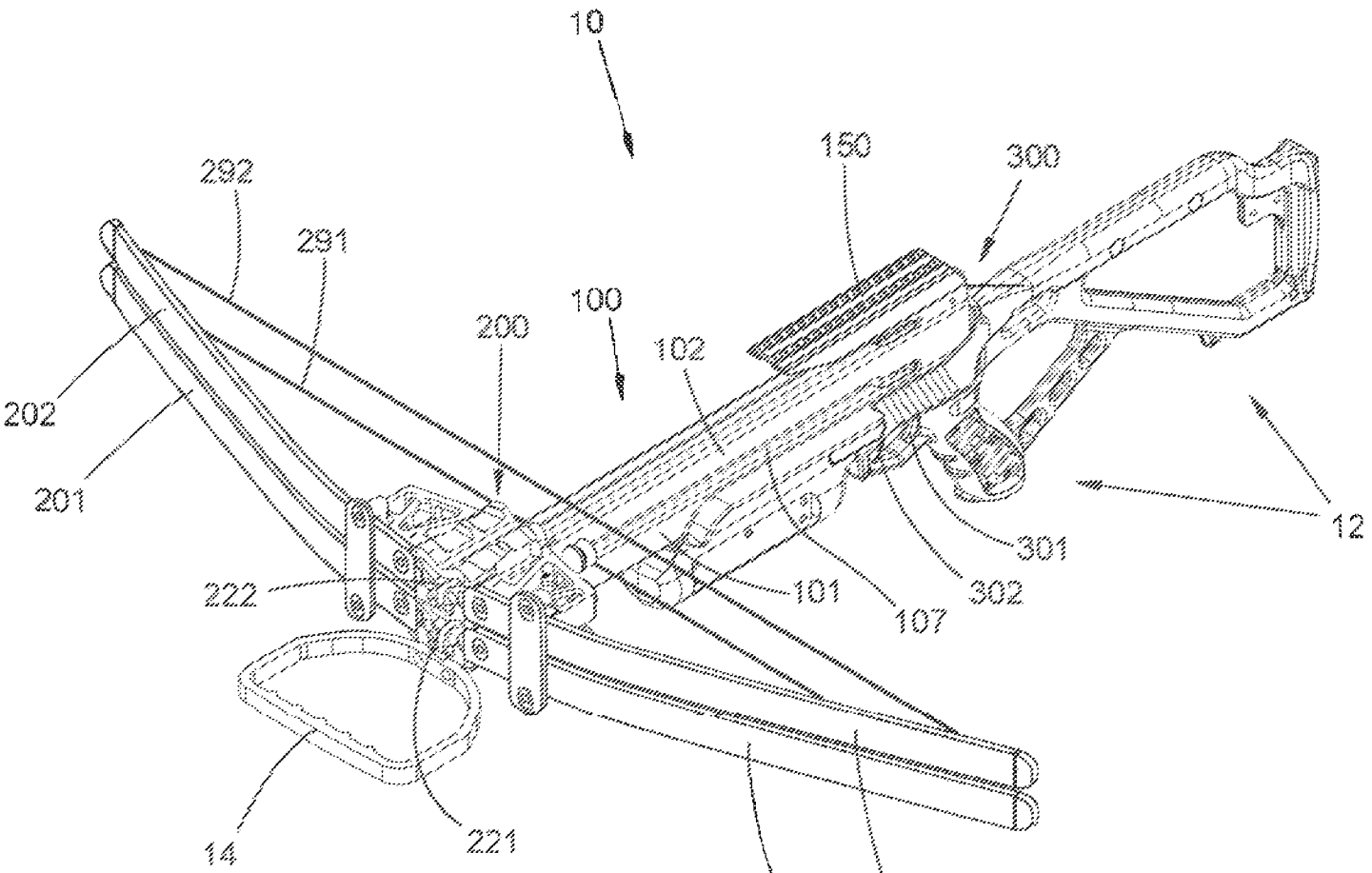
FIG. 6 is a perspective view of an example of a multiple-shot crossbow at brace, i.e., in an undrawn or rest position.
Figure 7:
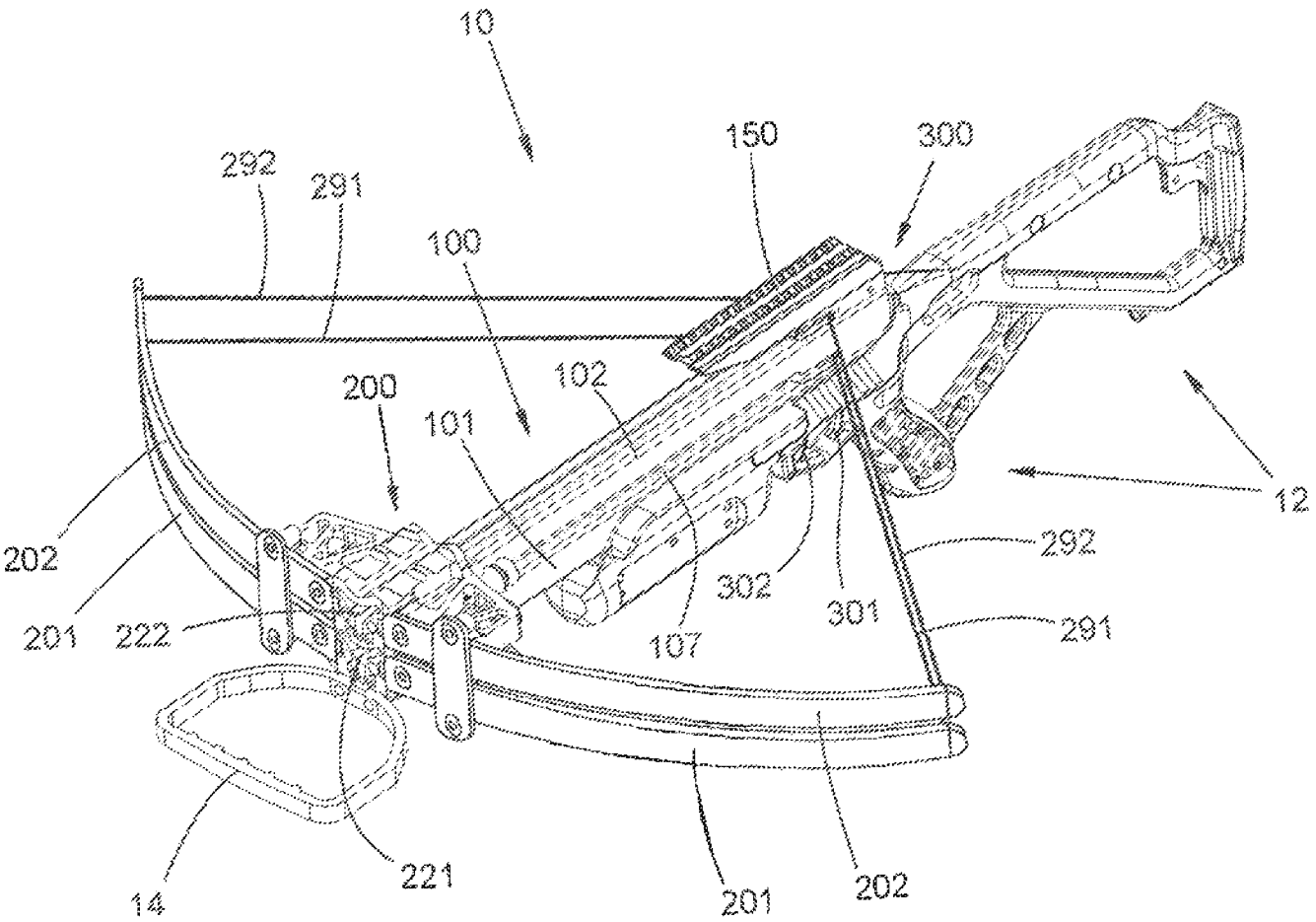
FIG. 7 is a perspective view of the example multiple-shot crossbow of FIG. 6 in a drawn position, before any bolt has been positioned on any rail.
Figure 8A:
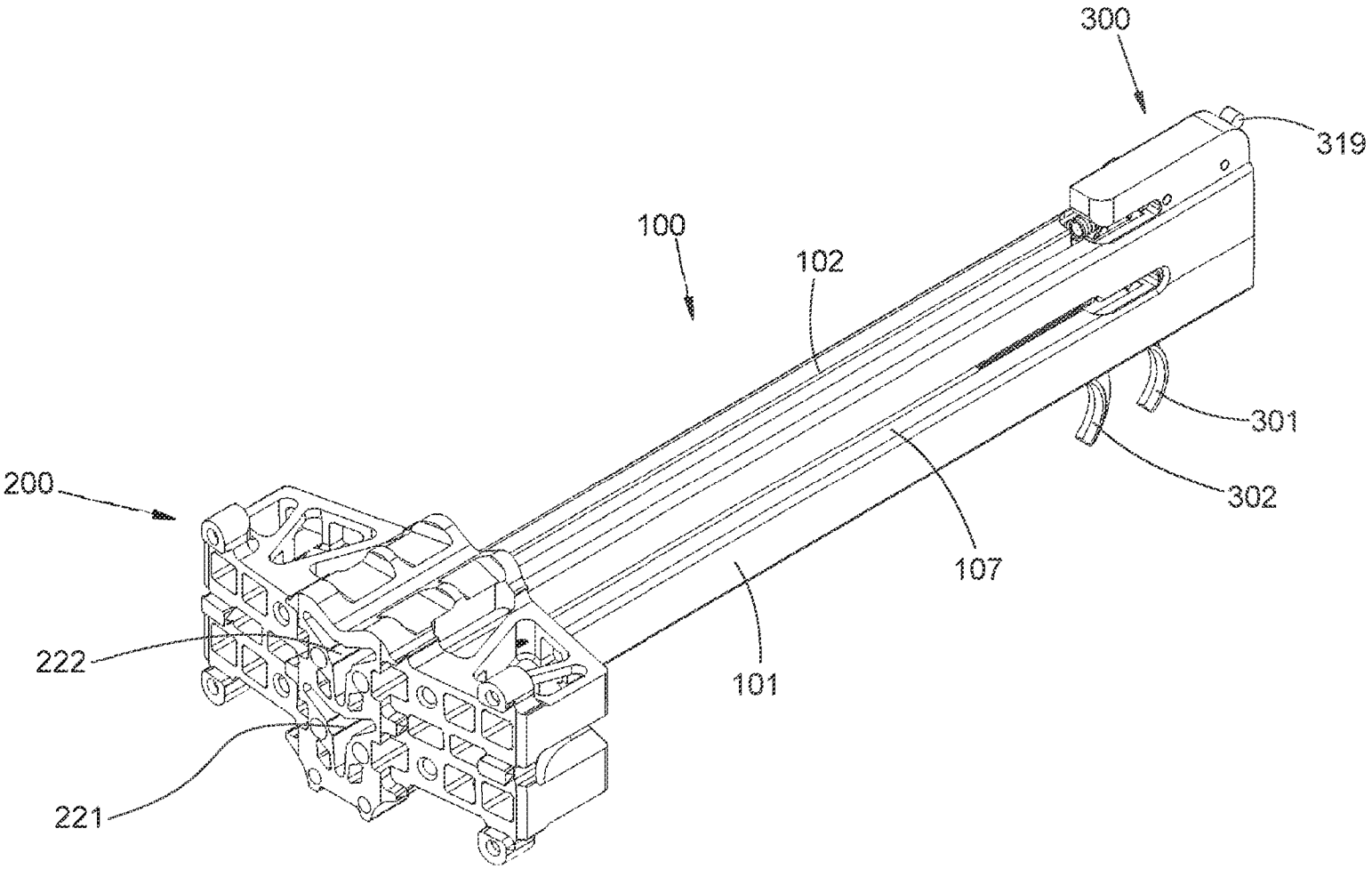
FIGS. 8A and 8B are perspective and side views, respectively, of the riser, mainframe, and trigger mechanism of the example multiple-shot crossbow of FIG. 6.
Figure 8B:
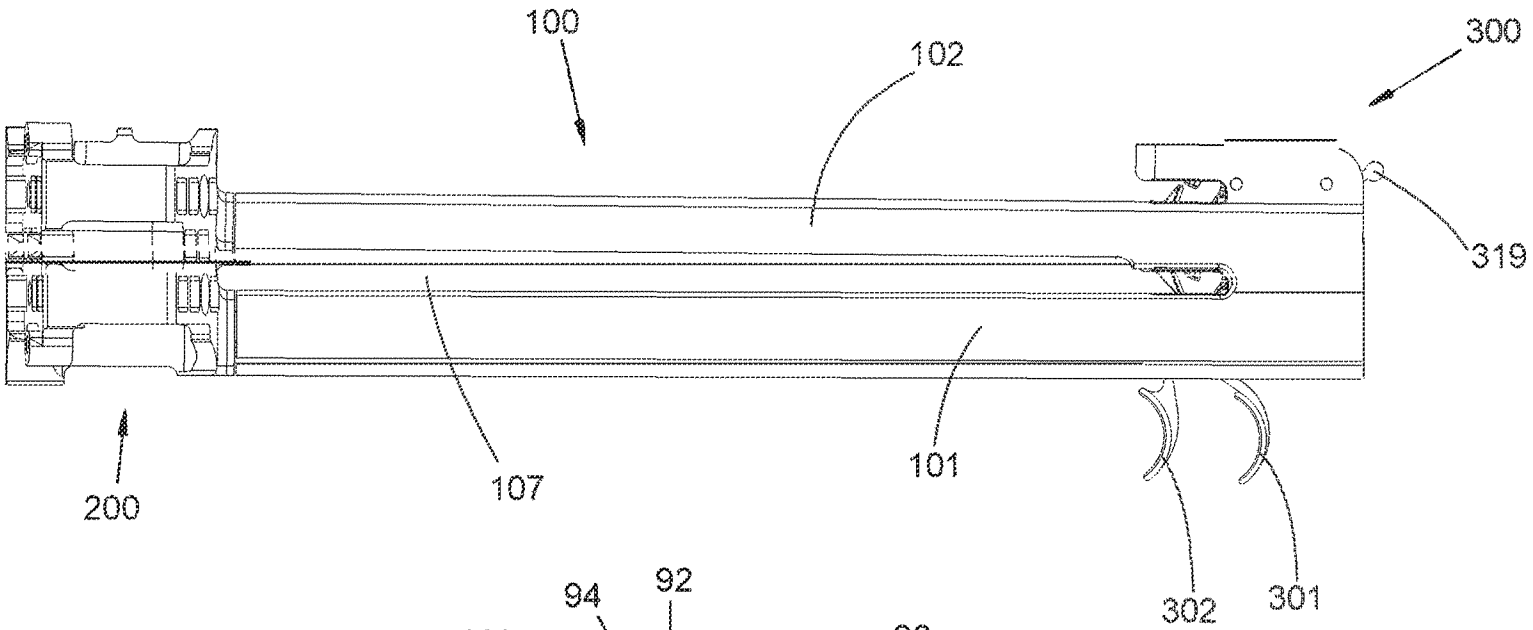

In one embodiment, the forward segment 22 is adapted as a shaft engagement portion. Accordingly, the forward segment 22 can be sized and shaped to be received and retained within a hollow rearward end 26 of a shaft 93/94 of an arrow or bolt 91/22, as shown in FIGS. 4 and 5 and discussed in greater detail below. The forward segment 22 can optionally comprise circumferential ridges and grooves 30, serrations or roughness (not shown), threads (not shown), or the like for engaging and retaining the nock 20 within the hollow rearward end 26 of the shaft 93/94. The forward segment 22 can be retained within the shaft 93/94 by friction or interference fit. In one embodiment, the forward segment 22 can be received and retained within the hollow rearward end 26 of the shaft 93/94 with a bushing (not shown) for a better fit or to protect the shaft 93/94. In other embodiments, the forward segment 22 may be adhered or otherwise secured within the shaft 93/94 through the use of an adhesive. It will be appreciated that one or more of the foregoing attachment methods may be utilized to connect nock 20 with an arrow or bolt shaft 93/94.

The rearward segment 24 and forward segment 22 may be formed of a unitarity piece of material in one embodiment. In other embodiments, the rearward segment 24 may comprise an element distinct from the forward segment 22 and/or be formed of distinctly different material. In further embodiments, a portion of the rearward segment 24 can be sized and shaped to be received and retained within a hollow rearward portion (not shown) of the forward segment 22. Conversely, a portion of the forward segment 22 can be sized and shaped to be received and retained within a hollow forward portion (not shown) of the rearward segment 24.

In yet another embodiment, the rearward segment 24 can be removably coupled with the forward segment 22, such that various rearward segments 24 can be interchangeably and/or replaceably coupled with the forward segment 22. In such embodiments, the rearward segment 24 can optionally comprise threads or circumferential or longitudinal ridges and grooves (not shown) for engaging with and retaining the rearward segment 24 within the hollow rearward portion of the forward segment 22. Conversely, the forward segment 22 may optionally comprise threads or circumferential or longitudinal ridges and grooves (not shown) for engaging with and retaining the forward segment 22 within the hollow forward portion of the rearward segment 24.

As illustrated in FIG. 2, the rearward segment 24 can define a rearward bearing surface 32 that is generally perpendicular to a longitudinal axis of the nock 20. In one embodiment, the rearward bearing surface 32 can define a generally circular shape. However, it will be understood that the rearward bearing surface 32 can define any suitable shape. The rearward bearing surface 32 can be generally planar or, as described below, may comprise other structural features. The rearward bearing surface 32 can be sized to be engaged by a bowstring 291/292. In one embodiment, the size of the rearward bearing surface 32 relative to the bowstring 291/292 can be large enough to increase the contact surface between the rearward bearing surface 32 and the bowstring 291/292 to reduce the amount of pressure and wear that the rearward bearing surface 32 imparts on the bowstring 291/292 through continued use. Further, in another embodiment, the rearward bearing surface 32 may comprise rounded, chamfered, or beveled edges 34 to reduce the sharp interaction with the bowstring 291/292 and further reduce the amount of pressure and wear that the rearward bearing surface 32 imparts thereon. Such rounded, chamfered, or beveled edges 34 can be associated with the outermost circumferential edges of the rearward bearing surface 32. If the rearward segment 24 defines a hollow cavity 36 (as discussed in more detail below), including a hollow cavity 36 concentrically aligned with the rearward bearing surface 32, such rounded, chamfered, or beveled edges 34 can also be associated with inner edges defining the hollow cavity 36 relative to the rearward bearing surface 32, as shown in FIG. 2. In some embodiments, the rearward bearing surface 32 does not contain a groove, slot, notch, channel, or the like, including, without limitation, for purposes of receiving and/or capturing the bowstring 291/292. In alternative embodiments, the rearward segment 24 may include one or more grooves, slots, notches, channels, half-moon or concave indentions, impressions, projections, arms, or the like designed to wholly or partially receive and/or capture the bowstring 291/292.

As further illustrated in FIG. 2, the rearward segment 24 may define a hollow cavity 36. An inner surface 48 of the hollow cavity 36 can optionally comprise threads or circumferential ridges and grooves (not shown) for engaging with various tools or implements (not shown) related to the use of the arrow or bolt 91/92. Put differently, this structure may form an internally threaded bore within the rearward segment 24. Such tools or implements can include pulling or gripping devices, such as T-shape threaded handles, for purposes of providing leverage for retrieving or removing a bolt 91/92 stuck in a target or other materials. Other such tools or implements can include lighted accessories for tracking flight path of the arrow or bolt 91/92 including during low-light conditions and environments.

As set forth above, the circumferential ledge or shoulder 28 can be provided in order to index the nock 20 longitudinally relative to the rearward end 26 of the arrow or bolt 91/92. The circumferential ledge or shoulder 28 may be part of the forward segment 22, part of the rearward segment 24, or part of an intermediate portion therebetween. However, any other suitable arrangement for enabling entry of the forward segment 22 into the shaft 93/94 while preventing entry of the rearward segment 24 into the shaft 93/94 can be employed while remaining within the scope of the present disclosure or appended claims. It will be understood that the nock 20 can be any nock, including a pin nock, an over nock, and the like.

The nock 20 may generally comprise a radial indention, which may be in the form of a circumferential or radial retention groove 38, as best shown in FIGS. 1-3. It will be appreciated that the radial indention may be any suitable form of indention, indentation, recess, groove, cavity, void, slot, notch, channel, debossment, depression, hole, aperture, socket, valley, or other structure suitable for being engaged by or receiving a portion of a projecting object therein. In alternative embodiments, in addition to or in substitution of the indention, the nock 20 may include a radially outwardly extending protrusion, projection, bump, protuberance, peak, ridge, embossment, or other structure for engagement with a recessed or projecting object.

The retention groove 38 can generally comprise a circumferential concave groove extending radially from a longitudinal axis defined by the nock 20. The retention groove 38 can extend at least partially around a respective cross-sectional segment of the nock 20, including entirely around the 360° segment of a circular cross-sectional segment of the nock 20. It will further be appreciated that the nock may comprise more than one retention groove 38 and that the retention groove 38 may be defined either continuously or intermittently around the circumference of the nock 20. In various embodiments, the retention groove 38 may be understood to be part of the rearward segment 24, part of the forward segment 22, or part of an intermediate portion therebetween.

As best shown in FIG. 3, the circumferential groove of the retention groove 38 may include a channel 40 defined by two generally opposing sides 42 radially extending from the channel 40 to the outer surface of the nock 20. The size, depth, width, cross-sectional profile, shape, and other characteristics of the retention groove 38 can vary from embodiment to embodiment. As demonstrated in FIG. 3, the retention groove 38 may have a half-moon or curved cross-sectional profile. In other embodiments, the retention groove 38 may have a generally V-shape, square, rectangular, or any other suitable cross-sectional profile. In one embodiment, the shape, size, profile and/or configuration of the retention groove 38 may corresponded with, and be suitable for receiving, at least a portion of an arrow or bolt retainer 321/322 or 321'/322' of a trigger mechanism 300, as discussed in greater detail below, for adequately retaining an arrow or bolt 91/92 in a desired position. In one embodiment, the retention groove 38 is adapted for receiving at least a portion of a detent mechanism 44, as further described below.

By reserving a portion of the nock 20 through the retention groove 38 to correspond with and receive a detent mechanism 44 of an improved biased bolt retainer 321'/322', the amount of wear that the improved biased bolt retainer 321'/322' imparts on the nock 20 through continued use can be reduced. Relatedly, the nock 20 and/or the retention groove 38 can comprise materials specifically designed to withstand the force from the interaction and/or impact of the detent mechanism 44 thereon through continued use. In one embodiment, the sides 42 extending from the channel 40 of the retention groove 38 can extend generally radially from the longitudinal axis defined by the nock 20, or at any other suitable angle relative thereto. The sides 42 extending from the channel 40 of the retention groove 38 can extend at the same or different angles relative to the longitudinal axis defined by the nock 20, and can be of different lengths, as desired.

Again, the retention groove 38 may be defined by the forward segment 22, by the rearward segment 24, between the forward segment 22 and the rearward segment 24, or by intermediate portion therebetween. The retention groove 38 can be machined, lathed, milled, and/or molded into the forward segment 22 or the rearward segment 24 of the nock 20. In another embodiment, the retention groove 38 can comprise an element separate from the forward segment 22 or the rearward segment 24 of the nock 20, and be coupled with or attached to the forward segment 22 or the rearward segment 24 of the nock 20. In a further embodiment, the retention groove 38 is defined between the forward segment 22 and the rearward segment 24 when the two segments are assembled or otherwise connected to one another.

Turning now to FIGS. 4-5, an arrow or bolt 91/92 is shown having the nock 20 installed at the rearward end 26 of its shaft 93/94. In one embodiment, a bolt 91/92 may include fletching 95/96, which may define longitudinal vanes, attached to a rearward portion of a circumferential surface of the shaft 93/94 of the bolt 91/92. Such longitudinal vanes of the fletching 95/96 can correspond with substantially longitudinal lines of attachment that can extend transversely from the shaft 93/94. The corresponding lines of attachment can be separated from one another by certain angles, including approximately 120° about the longitudinal axis of the shaft 93/94. A generally circular and/or generally planar rearward bearing surface 32 of the nock 20 can permit the bolt 91/92 to be fitted to the bowstring 291/292 in multiple orientations relative to the vanes defined by the fletching 95/96. One benefit of a rearward bearing surface 32 not having any grooves, slots, notches or channels is that the nock 20 may be installed into the bolt 91/92 at any rotational angle. In other words, the nock 20 does not need to be rotationally or angularly aligned or oriented relative to any of the vanes, such as the cock vane, thereby improving the ease of manufacturing and assembling the bolt 91/92 and the nock 20.

Relatedly, another benefit of a generally circular and/or generally planar rearward bearing surface 32 not having any grooves, slots, notches or channels is the increased flexibility of the rotational arrangement of the bolt 91/92 relative to the crossbow 10. In other words, in one embodiment of the present invention, the bolt 91/92 is not required to be loaded in the crossbow 10 in a specific orientation, which can be more user friendly and safer. Further, with the ability to selectively index the bolt 91/92 in multiple orientations (e.g., in any of three orientations offset by 120°), the bolt 91/92 is not always in the same orientation, thereby more evenly spreading wear over other circumferential segments of the bolt 91/92, as opposed to limiting the wear to a single segment of the bolt 91/92.

Figure 14:
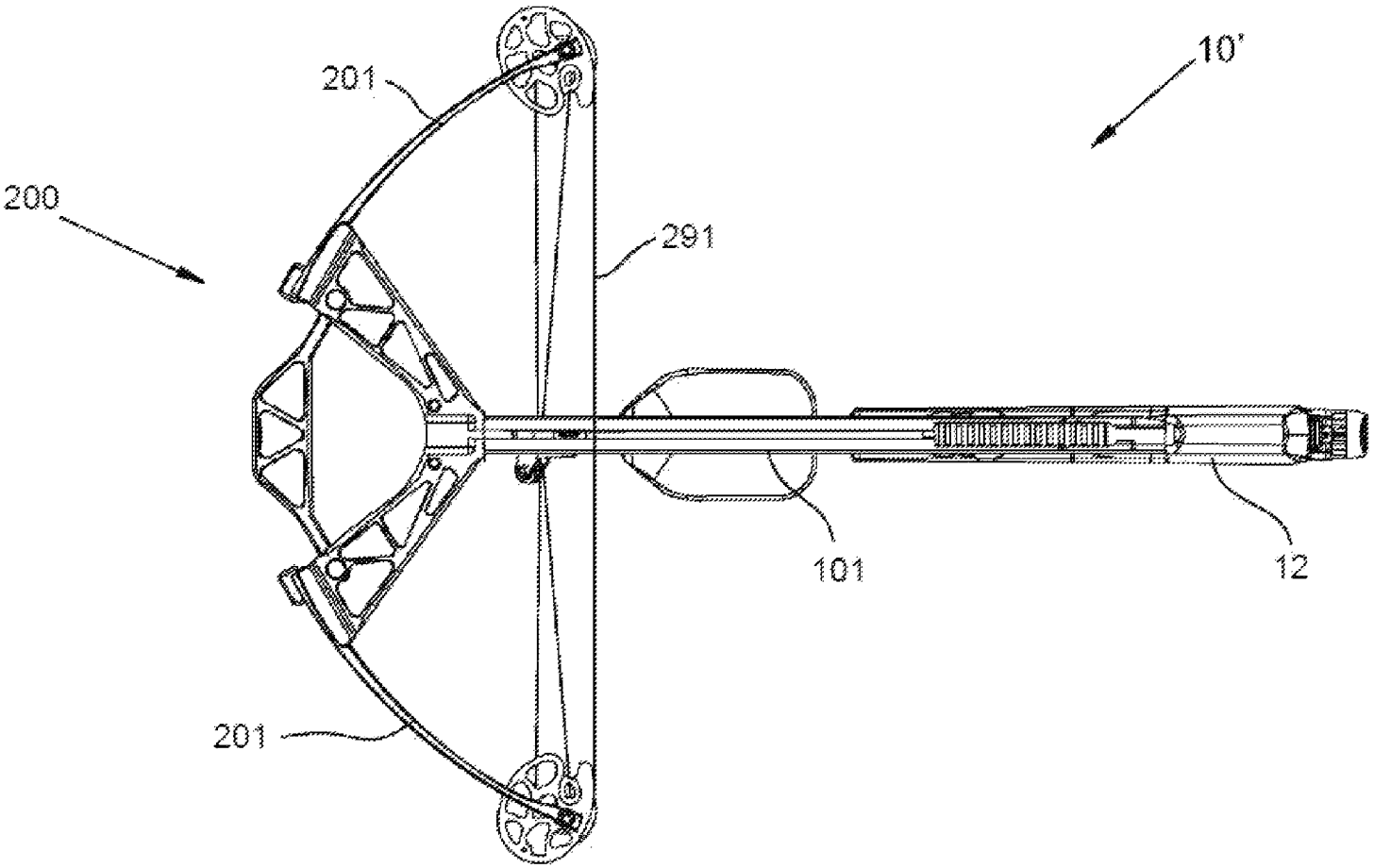
FIG. 14 is a top view of an example of a crossbow at brace, i.e., in an undrawn or rest position.
Figure 15:
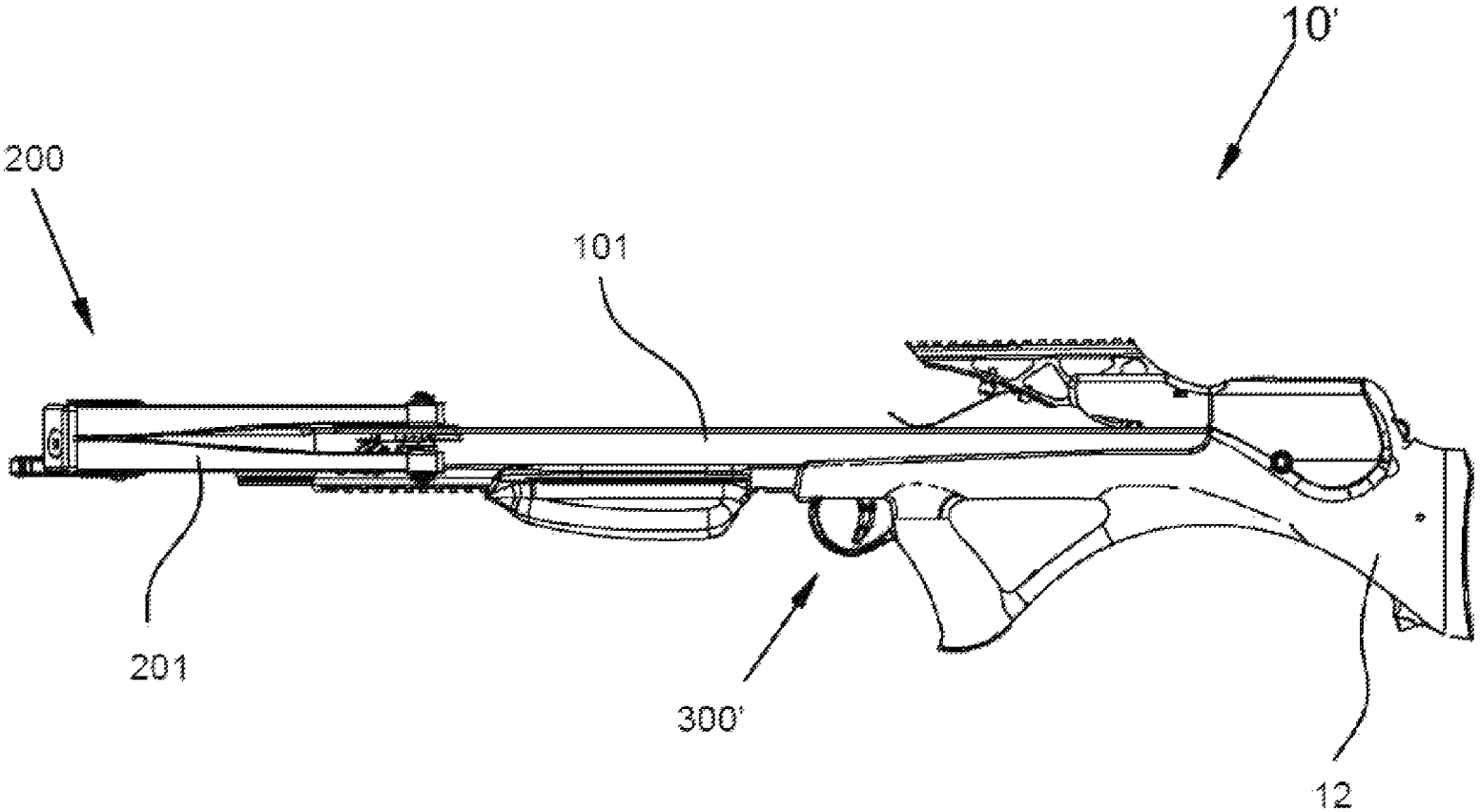
FIG. 15 is a side view of the example crossbow of FIG. 14 at brace, i.e., in an undrawn or rest position.

In addition to the inventive multiple-shot crossbow 10 illustrated in FIGS. 6-10, the inventive nock described above can be employed in a single-shot crossbow, such as crossbow 10' having only one rail, one pair of limbs, one bowstring, and a single trigger mechanism, like the crossbow 10' illustrated in FIGS. 14 and 15.

An example of an inventive multiple-shot crossbow 10 is shown in FIGS. 6-10. The crossbow 10 can include a mainframe 100, a riser 200, upper bow limbs 202, lower bow limbs 201, an upper bowstring 292, a lower bowstring 291, and a trigger mechanism 300. The crossbow 10 can include a stock 12 or any suitable type or arrangement, usually attached to a bottom portion of the mainframe 100 and extending downward and rearward from the mainframe 100. In some examples a stirrup 14 can be attached to the riser 200 to assist with manual drawing of the crossbow 10.

In some examples the crossbow 10 can include a draw mechanism of any suitable type or arrangement, including such elements as a crank, a cable or chain, gears or pulleys, a clutch or a brake, and so forth. The crossbow 10 is shown at brace in FIG. 6 and drawn in FIG. 7 (but with no bolts loaded).

The mainframe 100 can include a lower rail 101 and an upper rail 102. In many examples the lower rail 101 can include a longitudinal groove 103 on its top surface and the upper rail 102 can include a longitudinal groove 104 on its top surface (e.g., as in FIG. 9B). The rails 101/102 can be arranged one above the other with a longitudinal slot 107 between them that extends transversely through the mainframe 100. The rails 101/102 can be secured together at the front and back ends of the slot 107, e.g., by being attached to one another, integrally formed together as a unitary structure, both can be attached to the riser 200, both can be attached to the stock 12, or in any other suitable way. In the examples shown the rearward portions of the rails 101/102 can be attached to each other while forward portions of the rails 101/102 can be each attached to the riser 200. Each rail 101/102 can be arranged to support a bolt 91/92 positioned thereon and to guide the corresponding bolt 91/92 as it is launched from the crossbow 10. Each groove 103/104 (if present) receives one vane of the bolt's fletching 95/96 therein, so that the shaft 93/94 of the bolt 91/92 can rest on the corresponding rail 101/102. In many examples the arrangement of each rail 101/102 and its corresponding groove 103/104 described above is similar to the arrangement of a single rail and groove of a conventional, single-shot crossbow.

A riser 200 can be attached to a front end of the mainframe 100. A lower pair of bow limbs 201 and an upper pair of bow limbs 202 can be attached to the riser 200. Corresponding lower and upper bowstrings 291/292 can be attached to the lower and upper bow limbs 201/202, respectively. The bow limbs 201/202 and the bowstrings 291/292 can be arranged so that each bowstring 291/292 can move independently between corresponding brace and drawn positions. Each bowstring 291/292 can be drawn from its brace position (i.e., its resting position before the bow is drawn) to its drawn position while deforming the corresponding bow limbs 201/202. Each drawn bowstring 291/292 can be held in its drawn position by a corresponding portion of the trigger mechanism 300, and then released upon actuation of that corresponding portion of the trigger mechanism 300 (described further below). Upon release, each bowstring 291/292 can return to its brace position (under the impetus of the deformed bow limbs 201/202 returning to their shapes at brace) and thereby launches a bolt positioned on the corresponding rail 101/102. The mainframe 100 can include a longitudinal slot 107 that passes through the mainframe 100 between the lower and upper rails 101/102; the lower bowstring 201 can be movable between its brace and drawn positions within the longitudinal slot 107.

Figure 10:
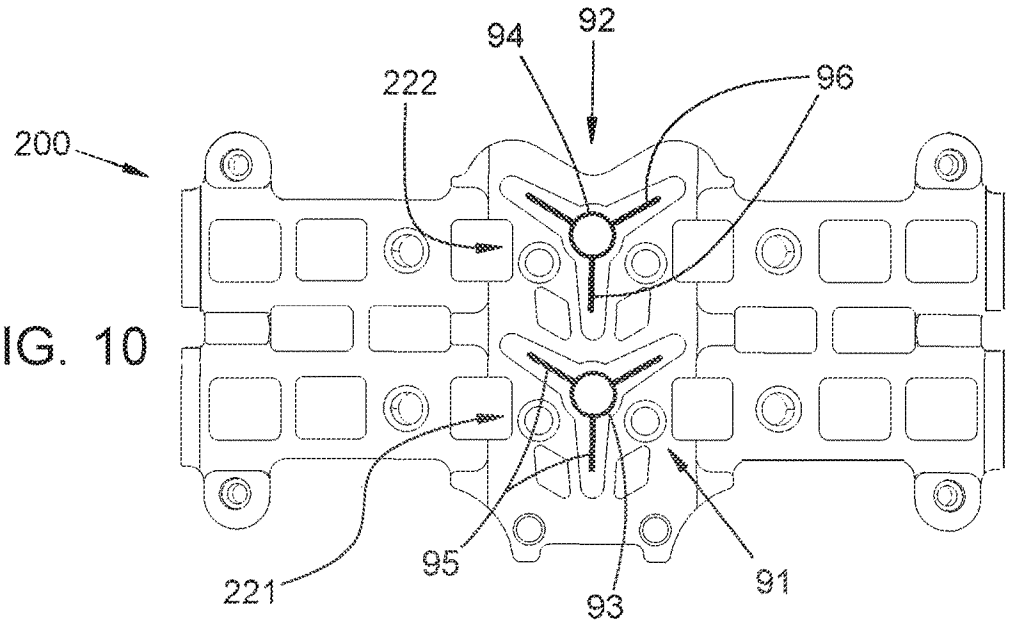
FIG. 10 is a front view of the riser of the example multiple-shot crossbow of FIG. 6, including bolts positioned for passing through the upper and lower riser passages.
Figure 9A:
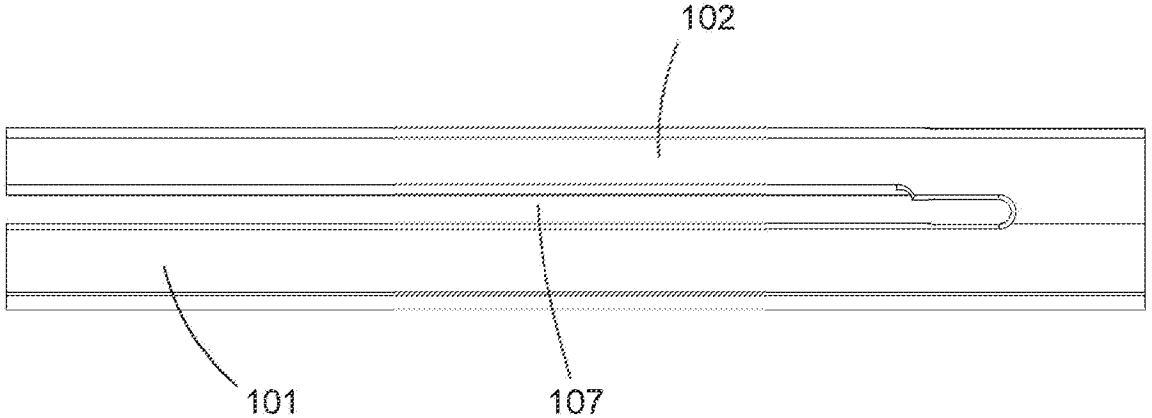
FIGS. 9A and 9B are side and front views, respectively, of the mainframe of the example multiple-shot crossbow of FIG. 6 (such views are not to scale), wherein the front view includes bolts positioned on the upper and lower rails.
Figure 9B:
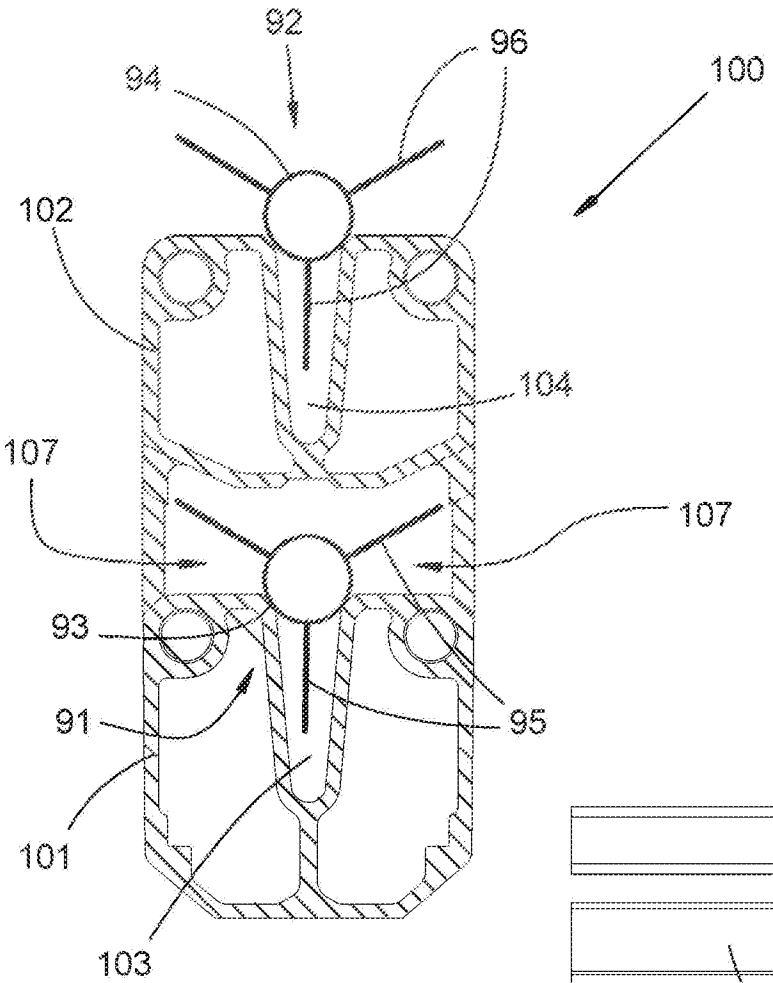

The riser 200 can include a longitudinal riser passage 221 that passes through the riser 200 (e.g., as in FIG. 10). The riser passage 221 can be arranged so that a bolt 91 can be inserted through the riser passage 221, positioned on the lower rail 101, and subsequently launched from the crossbow 10. In some examples the riser passage 200 can include a central hole (to accommodate a shaft 93 of the bolt 91 inserted through the riser passage 200) and three radial slots (to accommodate the fletching 95 of the bolt 91). The interior of the slot 107 and the riser passage 221 together form a somewhat enclosed, barrel-like chamber for a bolt 91 positioned on the lower rail 101. In some examples the riser 200 can include an upper longitudinal riser passage 222 that passes through the riser 200. That additional, upper riser passage 222 can be arranged so that a bolt 92 can be inserted through the upper riser passage, positioned on the upper rail 102, and subsequently launched from the crossbow 10. In examples that include an upper riser passage 222, it can include a central hole and three radial slots to accommodate the shaft 94 and fletching 96, respectively, of a bolt 92 positioned on the upper rail 102. Such an upper riser passage 222 can be employed, e.g., in examples wherein greater strength or stiffness of the riser 200 is needed or desired. In some examples, the mainframe 100 can include an enclosure (not shown) above the upper rail 102. Such an enclosure can be arranged so as to leave a longitudinal slot between the enclosure and the upper rail 102, forming a somewhat enclosed, barrel-like chamber for a bolt 92 positioned on the upper rail 102. In such examples, the upper bowstring 202 can be movable between its brace and drawn positions within the longitudinal slot between the enclosure and the upper rail 102.

The trigger mechanism 300 can be attached to a rear end of the mainframe 100. The trigger mechanism can be housed within a rearward portion of the mainframe 100, within its own housing 330 attached to the mainframe 100, or partly in each of those. An upper trigger portion can retain the upper bowstring 292 in its drawn position, and can release, upon actuation by a user, the upper bowstring 292 to return to its brace position. Similarly, a lower trigger portion can retain the lower bowstring 291 in its drawn position, and can release, upon actuation by the user, the lower bowstring 291 to return to its brace position. The trigger mechanism 300, and the upper and lower trigger portions thereof, can be of any suitable type or arrangement.

In some examples (e.g., as in FIG. 11 or FIGS. 12A/12B/12C; each rotation axis is marked with an "X"), (i) the lower trigger portion can include a lower trigger actuator 301, a lower sear 307, and a lower string catch 311, and (ii) the upper trigger portion can include an upper trigger actuator 302, an upper sear 308, and an upper string catch 312. Each string catch 311/312 can be movable between corresponding retention and release positions and biased toward the corresponding release position (biased clockwise in the examples shown). While in its corresponding retention position, each string catch 311/312 can retain the corresponding drawn bowstring 291/292 against tension exerted by the corresponding deformed bow limbs 201/202; upon biased movement to its corresponding release position, each string catch 311/312 can release the corresponding drawn bowstring 291/292, which then can return to its brace position propelled by the corresponding deformed bow limbs 201/202. Each sear 307/308 can be movable between corresponding firing and non-firing positions and biased toward the corresponding non-firing position (biased counterclockwise in the examples shown). While in its corresponding non-firing position, each sear 307/308 can hold the corresponding string catch 311/312 in its corresponding retention position; upon movement to its corresponding firing position (against its bias, urged by the corresponding trigger actuator 301/302), each sear 307/308 can permit biased movement of the corresponding string catch 311/312 to its corresponding release position. Each trigger actuator 301/302 can be movable between corresponding actuating and non-actuating positions. Each trigger actuator 301/302 can be linked to the corresponding sear 307/308 so as to move the corresponding sear to the corresponding firing position upon movement from the corresponding non-actuated position to the corresponding actuated position. In some examples, including that shown in the drawings, each trigger actuator 301/302 can be linked to the corresponding sear 307/308 by a corresponding linkage 305/306; in other examples (not shown) each trigger 301/302 can be linked directly to the corresponding sear 307/308. Bias on each sear 307/308 toward its corresponding non-firing position can also bias the corresponding trigger actuator 301/302 toward its corresponding non-actuated position.

In some examples (including the examples of FIGS. 11 and 12A/12B/12C), each of the upper and lower portions of the trigger mechanism 300 can be actuated independently of the other. Such independent actuation can enable the corresponding drawn bowstrings 291/292 to be released, and the bolts 91/92 positioned on the corresponding rails 101/102 to be launched, independently of one another by actuating the corresponding trigger actuator 301/302 (i.e., by moving the corresponding trigger actuator 301/302 from its non-actuated position to its actuated position). In some examples (not shown), the trigger mechanism 300 can include only a single trigger actuator that can act as both of the upper and lower trigger actuators; alternatively, the lower and upper trigger actuators 301/302 can be coupled together to act as a single trigger actuator (e.g., by coupling together the linkages 305 and 306 in the examples of FIG. 11 or 12A/12B/12C). In some such examples, the trigger mechanism 300 can be arranged for only one of (i) release of the bowstrings 291/292 together in response to a single actuation of the single trigger actuator, (ii) release of the bowstrings 291/292 sequentially in response to a single actuation of the single trigger actuator, or (iii) release of the bowstrings 291/292 sequentially in response to two sequential actuations of the single trigger actuator. In some other such examples, the trigger mechanism 300 can be arranged so as to enable switching among two or more of those three arrangements. In some examples, the trigger mechanism 300 can be arranged for switching between (i) an arrangement that can enable independent actuation of the trigger actuators 301/302 to release independently the corresponding bowstrings 291/292 in response to actuation of the corresponding trigger actuator 301/302, and (ii) an arrangement wherein the trigger actuators 301/302 can be coupled together so as to enable release of both of the bowstrings 291/292 in response to actuation of either trigger actuator 301/302 (e.g., by providing a removable pin for coupling together the linkages 305/306 if desired, or to be removed if not desired).

A crossbow can include a safety mechanism to prevent inadvertent actuation of a trigger mechanism and release of a drawn bowstring. The safety mechanism can include a mechanical stop or other element movable between a safety-on position (in which it obstructs movement of a trigger actuator to its actuated position, directly or by obstructing movement of a sear to its firing position) and a safety-off position (in which it can permit movement of the trigger actuator to its actuated position and movement of the sear to its firing position). The safety mechanism can be moved between its safety-off and safety-on positions manually by a user of the crossbow. In some examples of the multiple-shot crossbow 10, the trigger mechanism 300 can include a single safety mechanism, of any suitable type or arrangement, that can be movable between (i) its safety-on position (that prevents any actuation of the trigger mechanism 300 to release any bowstring 291 or 292), and (ii) its safety-off position (that allows any actuation of the trigger mechanism 300 to release either or both of the bowstrings 291/292).

In other examples (e.g., as in FIG. 11 or FIGS. 12A/12B/12C), the trigger mechanism 300 can include lower and upper safety mechanisms 317/318 (arranged to block movement of the corresponding sears 307/308 in the examples shown; any suitable type or arrangement can be employed). In various examples, the trigger mechanism 300 can be arranged so that each safety mechanism 317/318 can be moved between its corresponding safety-on and safety-off positions (i) independently of the other, (ii) only in tandem with the other, or (iii) only in opposition to the other. In the first instance, there is no coupling between the safety mechanisms 317/318 (e.g., by removing or splitting the coupler 316 in the examples of FIG. 11 or FIGS. 12A/12B/12C, and providing each safety mechanism 317/318 with its own lever); each can move independently of the other, and can be in its safety-on or safety-off position independently of the other. In the second instance, the safety mechanisms 317/318 can be coupled together (by the coupler 316 in the examples of FIG. 11 and FIGS. 12A/12B/12C, operated using the single lever 319) so that either: both safety mechanisms 317/318 can be in their respective safety-off positions; or both safety mechanisms 317/318 can be in their respective safety-on positions. In the third instance, the safety mechanisms 317/318 can be coupled together so that either: the safety mechanism 317 can be in its safety-off position and the safety mechanism 318 can be in its safety-on position; or the safety mechanism 317 can be in its safety-on position and the safety mechanism 318 can be in its safety-off position. The example of FIG. 11 can be altered to provide such operation, e.g., by moving the connection point of the coupler 316 on the safety mechanism 317 so that the safety mechanisms 317 and 318 counterrotate (instead of co-rotating as they do on FIG. 11). The example of FIGS. 12A/12B/12C can be altered to provide such operation, e.g., by suitably altering the position along the coupler 316 of one of the safety mechanisms 317/318.

Figure 11:
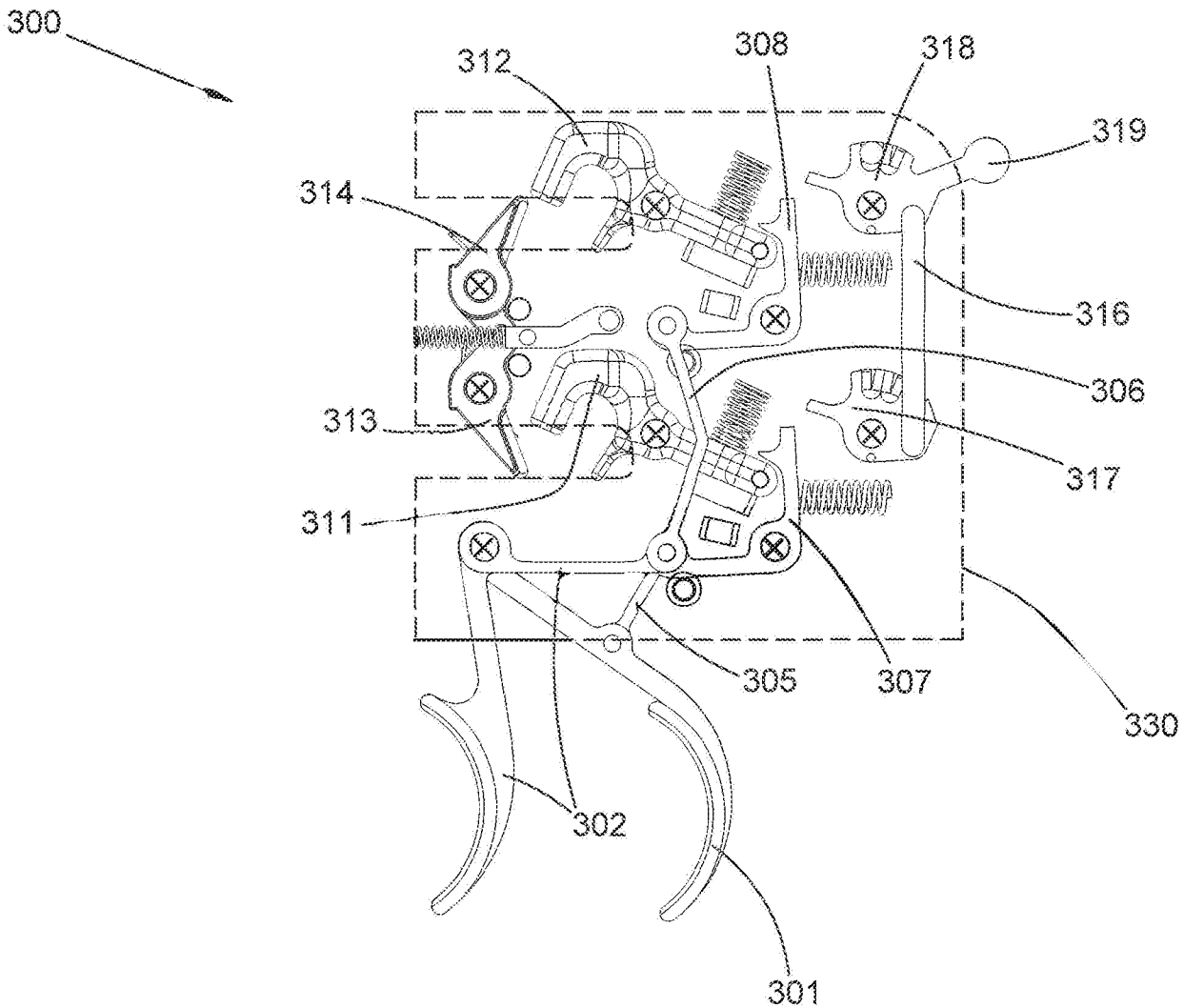
FIG. 11 is a side view of an example arrangement of the trigger mechanism for a multiple-shot crossbow.

A crossbow can include a so-called anti-dry-fire mechanism to prevent dry firing of the crossbow (i.e., triggering the crossbow and releasing a drawn bowstring without a bolt present to be launched). Such dry firing can damage the crossbow and can be hazardous to the user of the crossbow and bystanders. In some examples of the multiple-shot crossbow 10, the trigger mechanism 300 can include lower and upper anti-dry-fire mechanisms of any suitable type or arrangement. In the example of FIG. 11, with the corresponding bowstring 291/292 drawn and no bolt positioned on the corresponding rail 101/102, a corresponding spring-biased string latch 313/314 can be held by its bias force in its corresponding bolt-absent position, where it can prevent movement of the corresponding bowstring 291/292 from its drawn position. With a bolt positioned on the corresponding rail 101/102, the corresponding string latch 313/314 can be forced into its bolt-present position against its bias force, where it can permit movement of the corresponding bowstring 291/292 from its drawn position to its brace position.

Figure 12A:
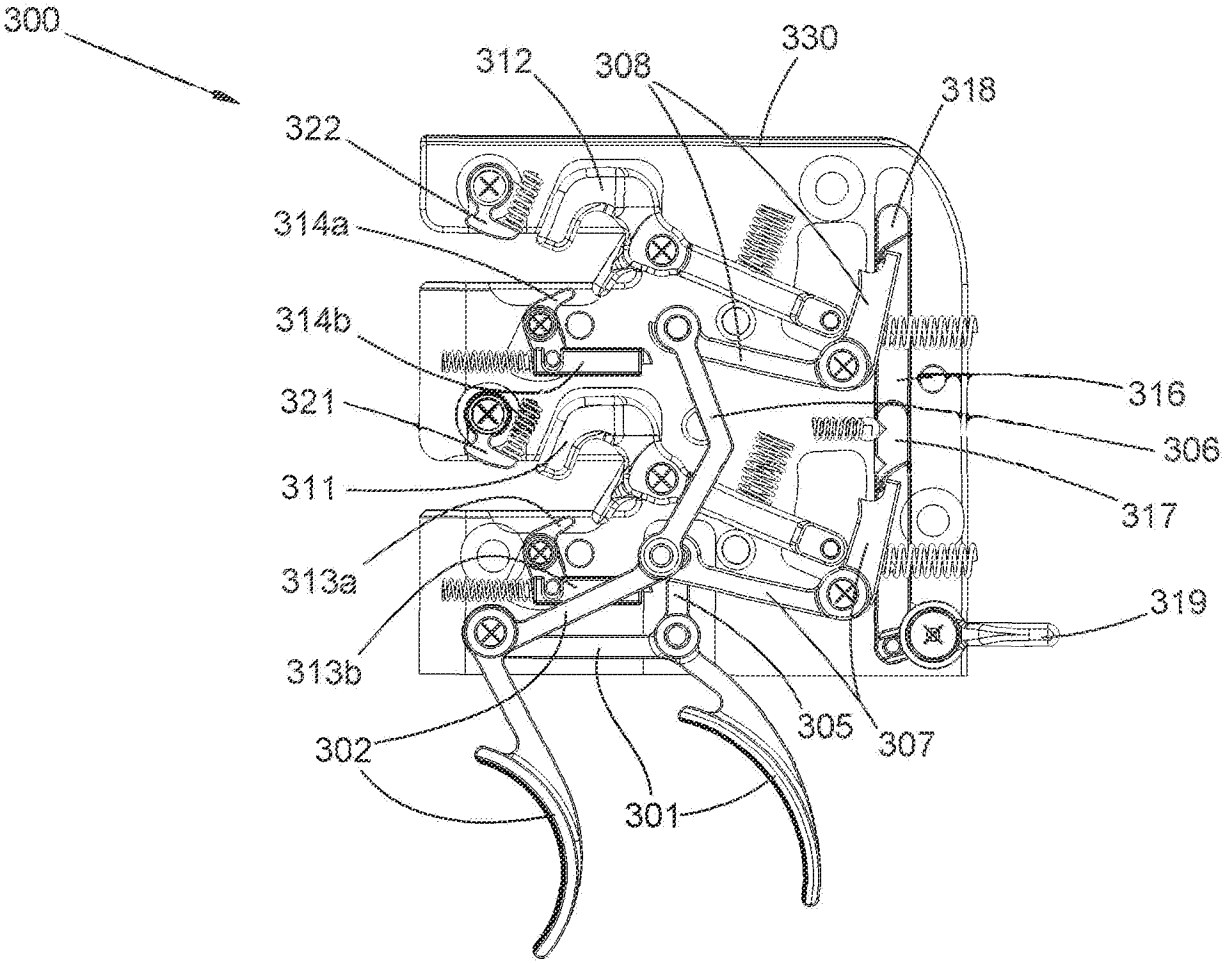
FIGS. 12A, 12B, and 12C are side views of another example arrangement of the trigger mechanism for a multiple-shot crossbow.
Figure 12B:
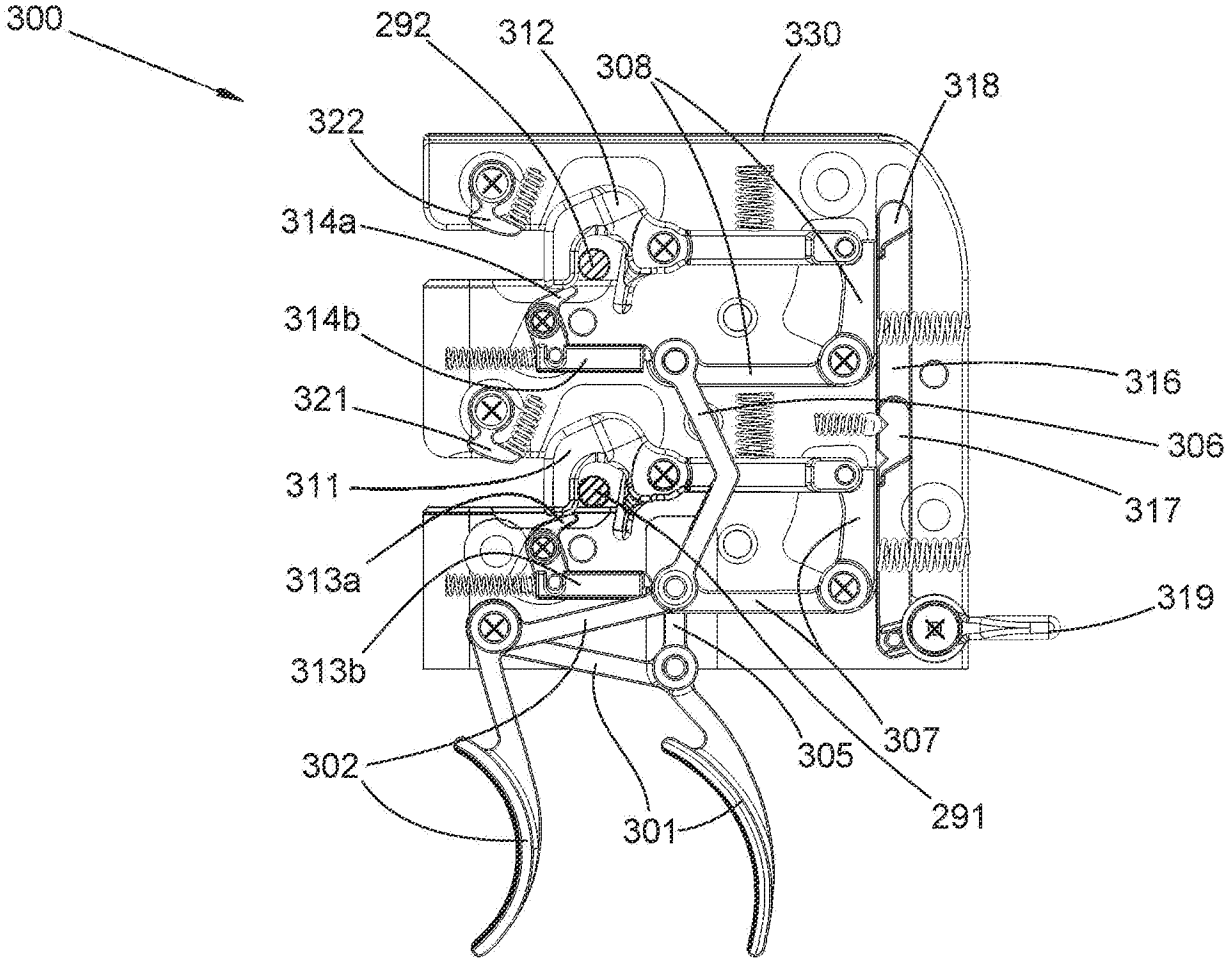

The example of FIGS. 12A/12B/12C incorporates an inventive anti-dry-fire mechanism into the each of the upper and lower trigger portions of the trigger mechanism 300. Each inventive anti-dry-fire mechanism can include a corresponding bolt sensor 313*a*/314*a* and a corresponding reciprocating sear latch 313*b*/314*b*. Each bolt sensor 313*a*/314*a* can be coupled to the corresponding sear latch 313*b*/314*b*. With the corresponding bowstring 291/292 drawn and with no bolt positioned on the corresponding rail 101/102 (as in FIG. 12B), the corresponding bolt sensor 313*a*/313*b* can be in its bolt-absent position and the corresponding sear latch 314*a*/314*b* can be held in its latched position by its bias force. In its latched position, the corresponding sear latch 314*a*/314*b* can engage the corresponding sear 307/308 and can prevent actuation of the corresponding trigger portion.

Figure 12C:
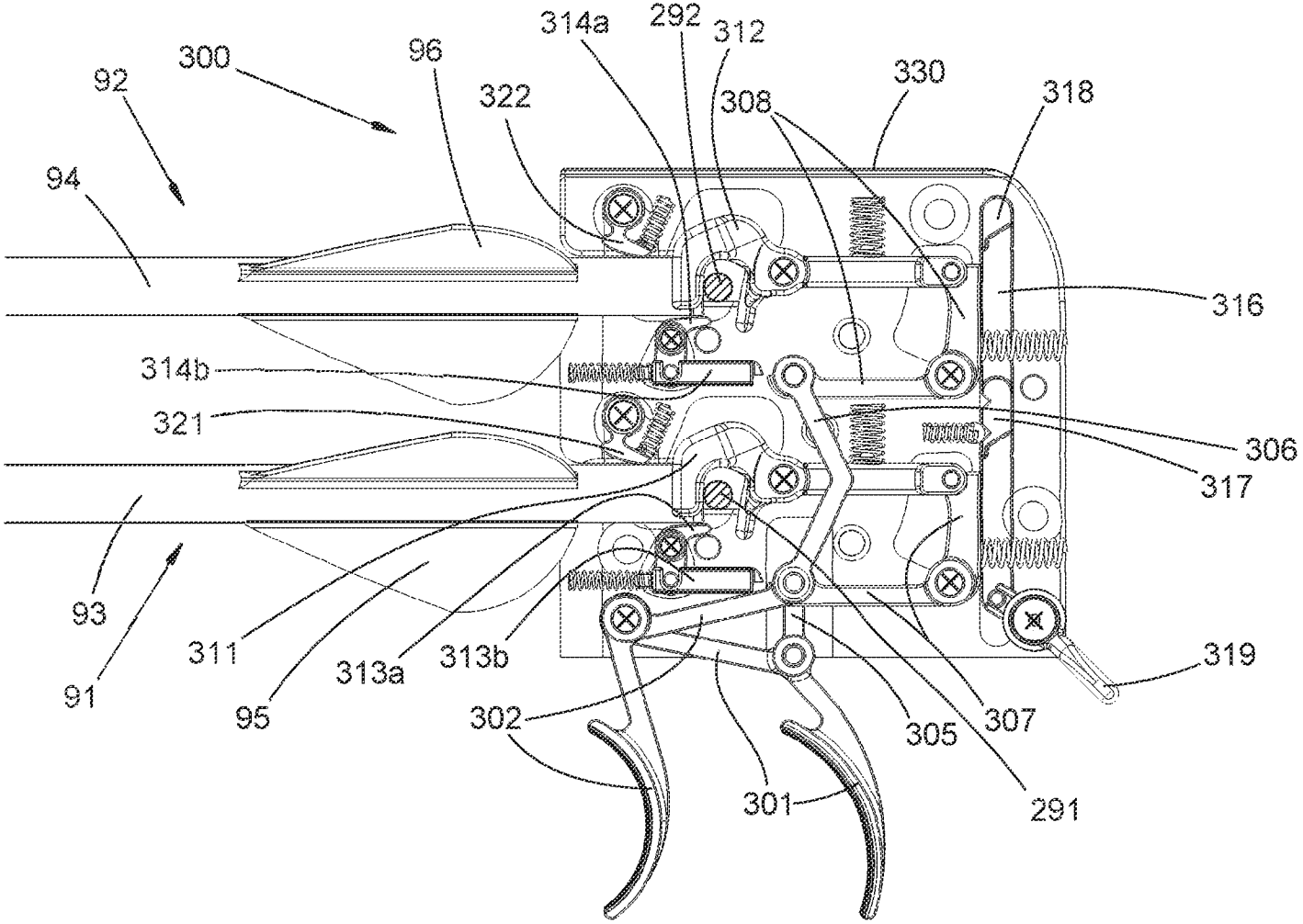

With the corresponding bowstring 291/292 drawn and a corresponding bolt 91/92 positioned on the corresponding rail 101/102 (as in FIG. 12C), the bolt 91/92 can hold the corresponding bolt sensor 313*a*/313*b* in its bolt-present position and in turn can hold the corresponding sear latch 314*a*/314*b* in its unlatched position against its bias force. In its unlatched position, the corresponding sear latch 314*a*/314*b* can be disengaged from the corresponding sear 307/308, thereby permitting actuation of the corresponding trigger portion to release the corresponding drawn bowstring 291/292 and launch the corresponding bolt 91/92 (returning the trigger mechanism 300 to the arrangement of FIG. 12A).

In some examples, each inventive anti-dry-fire mechanism can further include a corresponding biased bolt retainer 321/322. With a bolt 91/92 present on the corresponding rail 101/102, the corresponding bolt retainer 321/322 presses the bolt 91/92 against the corresponding bolt sensor 313*a*/314*a*. That arrangement can ensure that the presence of the bolt 91/92 can be sufficient to hold the corresponding bolt sensor 313*a*/314*a* in its bolt-present position, indirectly against the bias force on the corresponding sear latch 313*b*/314*b*. That arrangement also can prevent one of the bolts 91/92 from being dislodged from the corresponding bolt sensor 313*a*/314*a* when the other bolt 91/92 is launched. In some examples, each bolt retainer 321/322 can be structurally arranged to frictionally engage the corresponding bolt 91/92 positioned on the corresponding rail 101/102. In some of those examples each bolt retainer 321/322 can include an engagement surface with rounded or beveled front and back portions that facilitate movement of the corresponding bolt 91/92 along the corresponding rail 101/102.

In addition to the inventive multiple-shot crossbow 10, the inventive anti-dry-fire mechanism described above can be employed in a crossbow having only one rail, one pair of limbs, one bowstring, and a single trigger mechanism. The reciprocating arrangement of the sear latch can enable significant reduction of overall size relative to conventional anti-dry-fire mechanisms.

Figure 13A:
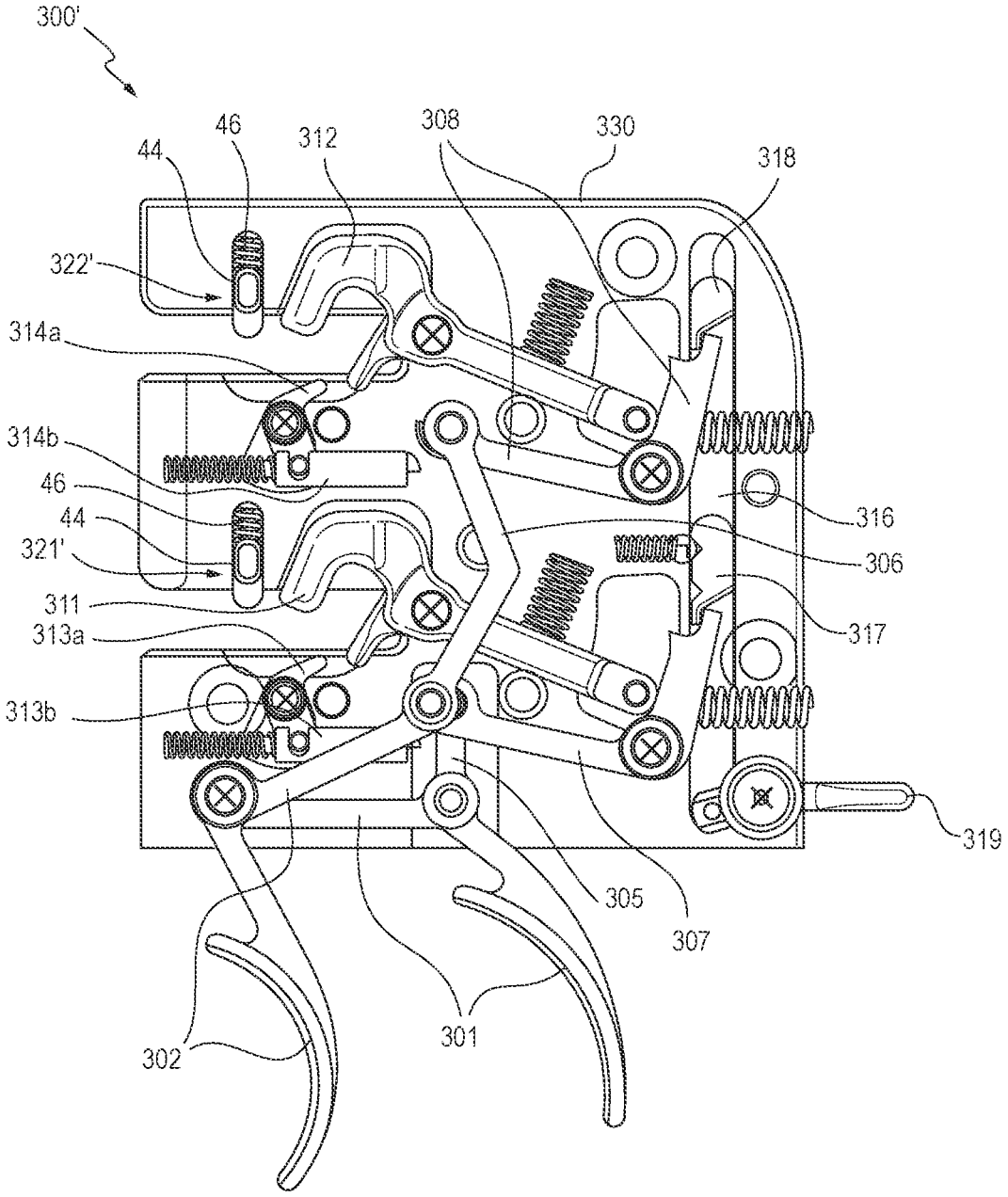
FIGS. 13A, 13B, and 13C are side views of yet another example arrangement of the trigger mechanism for a multiple-shot crossbow.
Figure 13B:
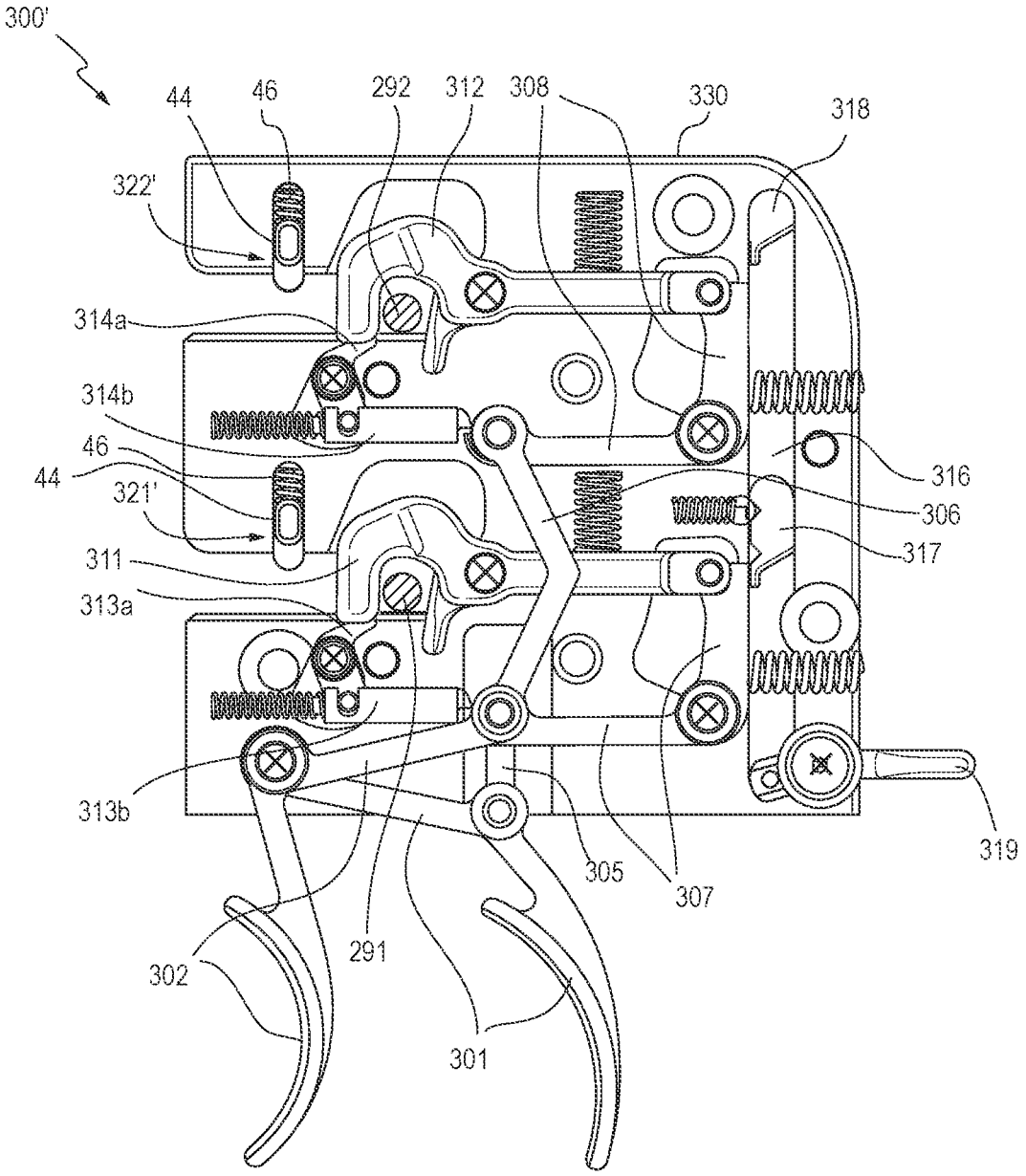
Figure 13C:
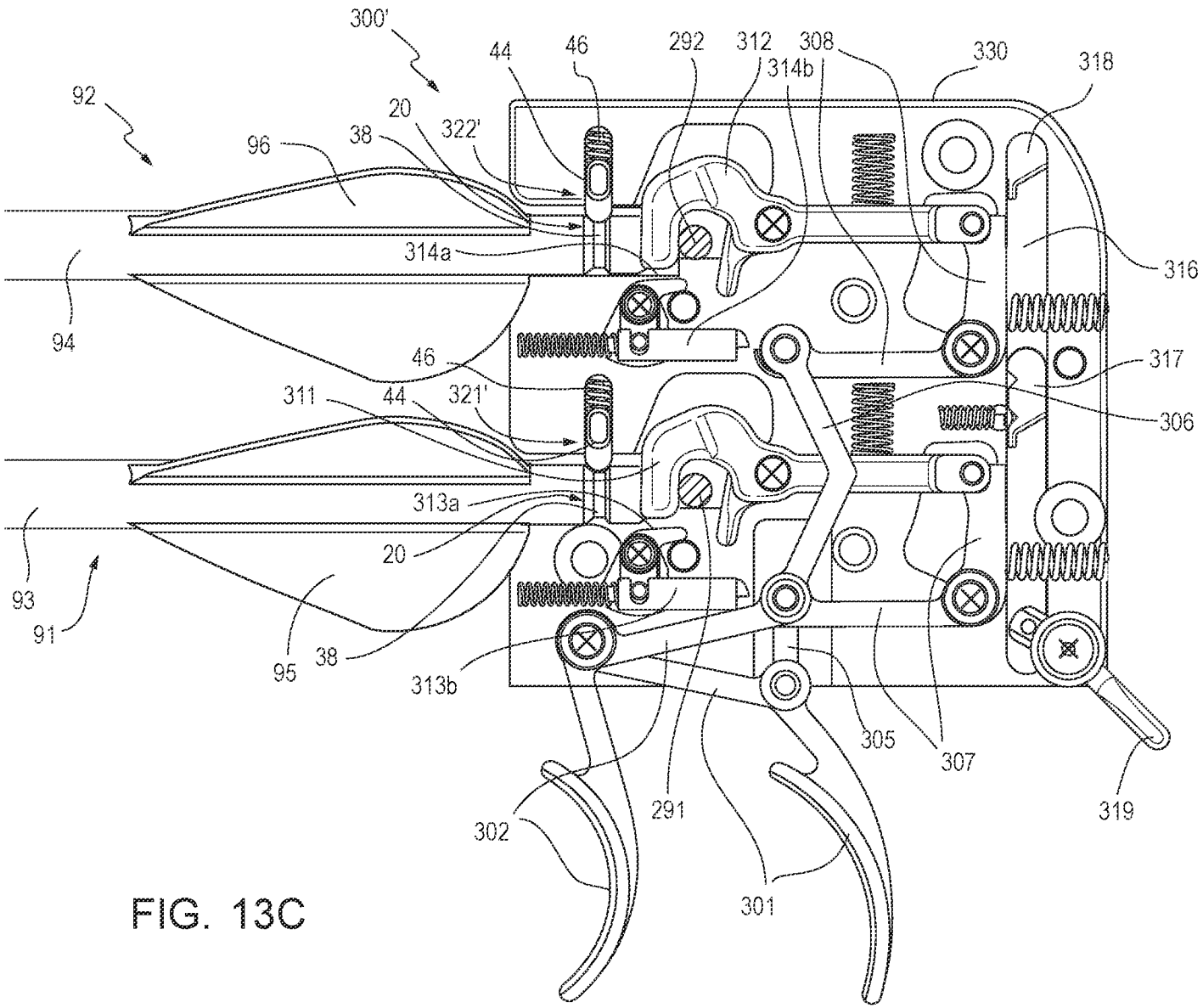

In other examples, as shown in FIGS. 13A/13B/13C, an improved trigger mechanism 300' can include an improved corresponding biased bolt retainer 321'/322'. With a bolt 91/92 present on the corresponding rail (not shown), the improved corresponding biased bolt retainer 321'/322' can engage the bolt 91/92, including by being received within a retention groove 38 of a nock 20, as shown in FIG. 13C. This engagement of the biased bolt retainer 321'/322' with the retention groove 38 may more firmly secure or fix the position of the bolt 91/92 relative to the trigger mechanism 300' and bowstring 291/292. This engagement can also prevent one of the bolts 91/92 from shifting or becoming dislodged from its generally fixed position during handling and/or when another bolt 91/92 is launched.

The biased bolt retainer 321'/322' can generally comprise a detent mechanism 44 and a biasing means 46, wherein the biasing means 46 can provide a biasing force for retaining the detent mechanism 44 in a general bolt-absent position. With a bolt positioned on the corresponding rail, the detent mechanism 44 can be forced into its bolt-present position, against the bias force provided by the biasing means 46, by radial forces applied to the detent mechanism 44 by the bolt 91/92, including the nock 20 and/or shaft 93/94 thereof. In one embodiment, the detent mechanism 44 can comprise a spherical ball, a cylindrical pin (including a detent pivot, a selector detent pin, and the like), a plunger, other rounded or beveled shapes, and any other suitable mechanism. The biasing means 46 may include a compression spring; however, it will be understood that the biasing means 46 can comprise any suitable biasing means.

The detent mechanism 44 can be sized, shaped, and arranged to be received within and retain the retention groove 38 of a nock 20. In one embodiment, the length of the detent mechanism 44 can correspond with the depth of the channel 40 of the retention groove 38. In another embodiment, the width of the detent mechanism 44 can correspond with the width or defined distance between the two sides 42 extending from the channel 40 of the retention groove 38. Such proper sizing and arrangement of the detent mechanism 44 being capable of adequately retaining the bolt 91/92 in a fixed position relative to the improved trigger mechanism 300'. The biased bolt retainer 321'/322' can prevent the bolt 91/92 from shifting or being dislodged from its generally fixed position relative to the improved trigger mechanism 300' during handling and/or when another bolt 91/92 is launched.

The location of the biased bolt retainer 321'/322' relative to the improved trigger mechanism 300' can correspond with the location of the retention groove 38 relative to the rearward end 22 of the shaft 93/94 and/or the rearward bearing surface 32 of the nock 20. In one embodiment, the biased bolt retainer 321'/322' can be located within the trigger mechanism 300' generally forward of the string catch 311/312 to engage with the retention groove 38 when the rearward bearing surface 32 of the nock 20 is fitted to a bowstring 291/292.

The biased bolt retainer 321'/322' can retain the bolt 91/92 in a fixed position relative to the improved trigger mechanism 300' and/or bowstring 291/292 through a combination of compression forces bearing radially on the retention groove 38 of the nock 20 and shear forces resisting the general longitudinal movement of the bolt 91/92, including the nock 20 thereof. In one embodiment, the biased bolt retainer 321'/322' can allow the bolt 91/92 rotate freely about its longitudinal axis, including in a 360° range of rotation, while retaining the bolt 91/92 in a longitudinally fixed position relative to the improved trigger mechanism 300'. In other embodiments, the improved biased bolt retainer 321'/322' can be structurally arranged to frictionally engage the bolt 91/92 positioned on a rail.

In another embodiment, with a bolt 91/92 present on the rail, the improved biased bolt retainer 321'/322' presses the bolt 91/92 against a bolt sensor 313*a*/314*a* of the anti-dry-fire mechanism. That arrangement can ensure that the presence of the bolt 91/92 can be sufficient to hold the bolt sensor 313*a*/314*a* in its bolt-present position, indirectly against the bias force on a sear latch 313*b*/314*b*. That arrangement also can prevent one of the bolts 91/92 from being dislodged from the bolt sensor 313*a*/314*a* during movement or transportation and/or when another bolt 91/92 is launched.

In addition to the inventive multiple-shot crossbow 10, the inventive improved biased bolt retainer described above can be employed in a crossbow 10' having only one rail, one pair of limbs, one bowstring, and a single trigger mechanism, like the crossbow 10' illustrated in FIGS. 14 and 15.

Figure 16:
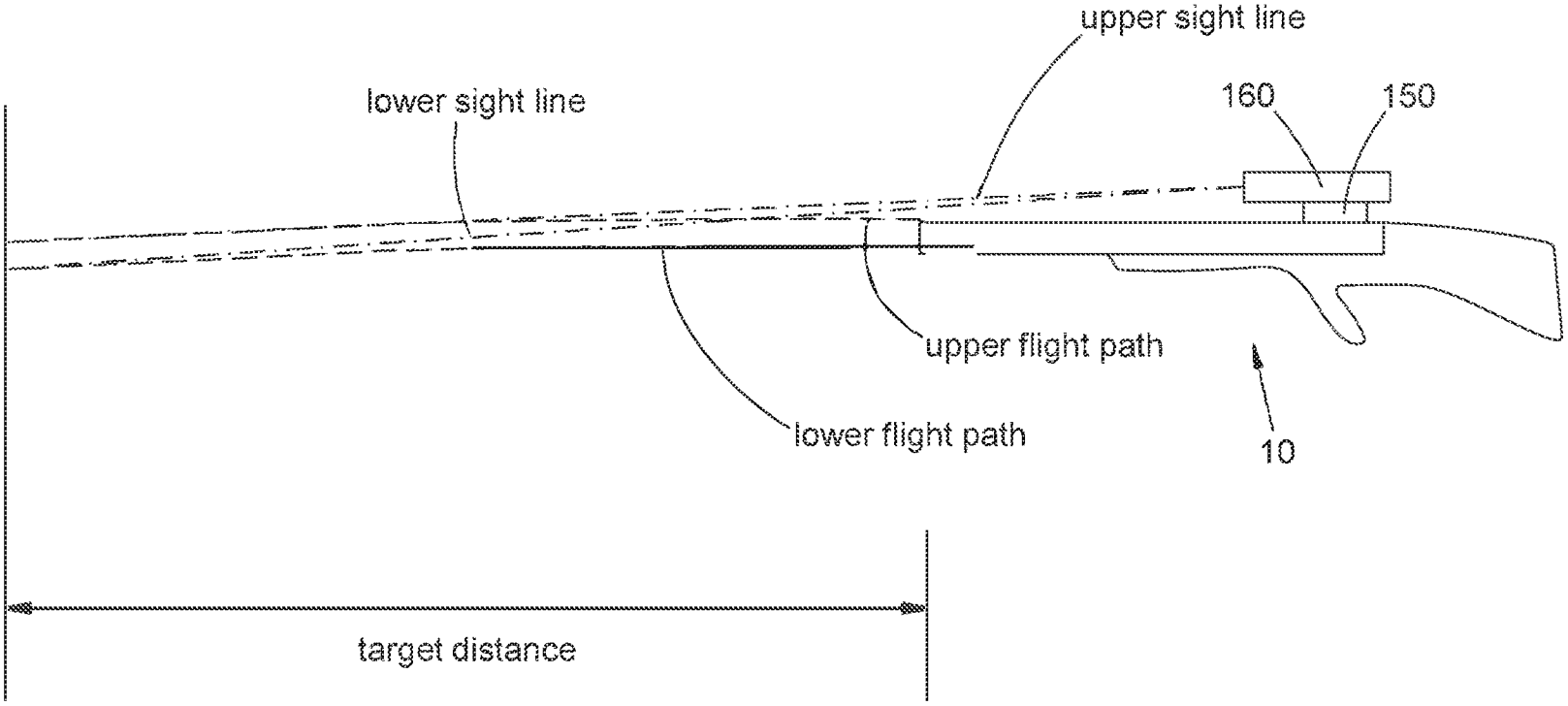
FIG. 16 illustrates schematically use of different upper and lower sight positions for aiming bolts fired from the upper and lower rails, respectively.

In some examples the crossbow 10 can include a mounting bracket 150 for a sight 160. The mounting bracket 150 can be attached to a rearward portion of the mainframe 100. Because the rails 101/102 can be at different heights, their respective flight paths can be also displaced vertically from one another (e.g., as illustrated schematically in FIG. 16). If the sight 160 is aligned optimally with respect to one flight path, it cannot also be optimally aligned with the other. Accordingly, the mounting bracket 150 can be arranged to be movable between defined upper and lower sight positions at slightly different angles relative to the mainframe 100. The defined sight positions can be selected so that with the mounting bracket 150 in, e.g., the lower sight position, optimal alignment of the sight 160 with respect to the flight path of a bolt 91 launched from the lower rail 101 results in equivalent alignment of the sight 160, with the mounting bracket 150 in the upper sight position, with respect to the flight path of a bolt 92 launched from the upper rail 102. In other words, "dialing in" the sight 160 for a bolt 91 on the lower rail 101, with the mounting bracket 150 in the lower position, results in the sight 160 being similarly "dialed in," after moving the mounting bracket to the upper position, for a bolt 92 on the upper rail 102. Conversely, "dialing in" the sight 160 for the bolt 92 on the upper rail 102, with the mounting bracket in the upper position, results in the sight 160 being similarly "dialed in," after moving the mounting bracket 150 to the lower position, for the bolt 91 on the lower rail 101. The closest equivalence of the upper and lower alignments occurs at only one target distance from the crossbow 10, but in many instances can be sufficiently close over a range of target distances. In some examples, difference between the upper and lower sight positions can be fixed; in other examples the difference can be adjustable. The mounting bracket 150 of mainframe 110 can include an indexing structure, detent, stop, or other suitable mechanical arrangement to define the upper and lower sight positions for the mounting bracket 150. After shooting one of the bolts 91/92 with the mounting bracket 150 in the corresponding sight position, the user of the crossbow can quickly switch the sight 160 from one alignment to the other by moving the mounting bracket 150 to the other sight position before shooting the second of the bolts 91/92.

The crossbow 10 can include bow limbs 201/202 and bowstrings 291/292 of any suitable type or arrangement. In some examples (including those shown in the drawings) one or both pairs of bow limbs 201/202 can be simple, straight limbs (which become curved as they are deformed, e.g., when the bow is rigged or drawn). In some examples (not shown), one or both pairs of bow limbs 201/202 can be recurve limbs. In some examples (not shown), one or both pairs of limbs 201/202 can have corresponding rotatably mounted pulley members engaged with a corresponding bowstring 291/292 and with one or more corresponding power cables (i.e., arranged as a compound crossbow).

The preceding description and the examples shown in the drawings include two rails 101/102, two pairs of bow limbs 201/202, and two bowstrings 291/292. In other examples (not shown) of the multiple-shot crossbow 10, the mainframe 100 can further include at least one additional longitudinal rail (above the upper rail 102) with a corresponding longitudinal groove. The additional rail can be arranged to support an additional bolt with one vane of its fletching received within the groove, and to guide that additional bolt as it is launched from the multiple-shot crossbow. In such examples, the riser 200 can further include at least one additional longitudinal upper riser passage, to accommodate the bolt 92 on the upper rail 102, and the crossbow can further include (i) at least one additional pair of bow limbs attached to the riser 200 above the upper bow limbs 202, and (ii) at least one additional bowstring attached to the corresponding additional pair of bow limbs. The additional bow limbs and bowstring can be arranged to be drawn, and then released (by a suitably arranged trigger mechanism 300) to launch a bolt positioned on the additional rail, in any suitable manner including those described above for the rail 101/102, bow limbs 201/202, bowstrings 291/292, and trigger mechanism 300. Various examples can be arranged for simultaneous loading and rapid firing of two, three, four, or more bolts, as needed or desired.

In addition to the preceding, the following example embodiments fall within the scope of the present disclosure or appended claims:

Example 1. A crossbow comprising: (a) a mainframe including substantially parallel upper and lower longitudinal rails, each rail being arranged so as to support a corresponding bolt positioned thereon and to guide the corresponding bolt as the corresponding bolt is launched from the crossbow; (b) a riser attached to a front end of the mainframe, the riser including a longitudinal riser passage therethrough arranged so as to enable a bolt to be inserted through the riser passage, positioned on the lower rail, and subsequently launched from the crossbow; (c) upper and lower pairs of bow limbs attached to the riser, and corresponding upper and lower bowstrings attached to the upper and lower bow limbs, respectively, the bow limbs and bowstrings being arranged so that each bowstring can independently (i) be drawn from a corresponding brace position to a corresponding drawn position while deforming the corresponding bow limbs and (ii) return to the corresponding brace position and thereby launch a bolt positioned on the corresponding rail, the lower bowstring being movable between the corresponding brace and drawn positions within a longitudinal slot passing through the mainframe between the upper and lower rails; and (d) a trigger mechanism attached to a rear end of the mainframe and including (i) an upper trigger portion arranged so as to retain the upper bowstring in the corresponding drawn position and release, upon actuation by a user, the upper bowstring to return to the corresponding brace position, and (ii) a lower trigger portion arranged so as to retain the lower bowstring in the corresponding drawn position and release, upon actuation by the user, the lower bowstring to return to the corresponding brace position.

Example 2. The crossbow of Example 1 wherein each rail can include a corresponding longitudinal groove arranged so as to (i) support a corresponding bolt positioned on the corresponding rail with one vane of fletching of the corresponding bolt received within the corresponding groove and (ii) guide the corresponding bolt as the corresponding bolt is launched from the crossbow.

Example 3. The crossbow of any one of Examples 1 or 2 wherein the riser passage can include a central hole arranged so as to accommodate a shaft of a bolt inserted through the riser passage and three radial slots arranged so as to accommodate fletching of the bolt inserted through the riser passage.

Example 4. The apparatus of any one of Examples 1 through 3 wherein the riser can include a longitudinal upper riser passage therethrough arranged so as to enable a bolt to be inserted through the upper riser passage, positioned on the upper rail, and subsequently launched from the crossbow.

Example 5. The crossbow of Example 4 wherein the upper riser passage can include a central hole arranged so as to accommodate a shaft of a bolt inserted through the upper riser passage and three radial slots arranged so as to accommodate fletching of the bolt inserted through the upper riser passage.

Example 6. The crossbow of any one of Examples 1 through 5 wherein the mainframe can include an enclosure above the upper rail, the upper bowstring being movable within a longitudinal slot between the enclosure and the upper rail.

Example 7. The crossbow of any one of Examples 1 through 6 wherein the trigger mechanism can include a single safety mechanism movable between (i) a safety-on position that can prevent actuation of the trigger mechanism and (ii) a safety-off position that allows actuation of the trigger mechanism.

Example 8. The crossbow of any one of Examples 1 through 6 wherein the trigger mechanism can include upper and lower safety mechanisms, each safety mechanism being movable between (i) a corresponding safety-on position that can prevent actuation of a corresponding portion of the trigger mechanism and (ii) a corresponding safety-off position that allows actuation of the corresponding portion of the trigger mechanism.

Example 9. The crossbow of Example 8 wherein each safety mechanism can be movable between the corresponding safety-on and safety-off positions independently of the other safety mechanism.

Example 10. The crossbow of Example 8 wherein the upper and lower safety mechanisms can be coupled together so that (i) with the upper safety mechanism in the safety-on position the lower safety mechanism can be in the safety-on position and (ii) with the upper safety mechanism in the safety-off position the lower safety mechanism can be in the safety-off position.

Example 11. The crossbow of Example 8 wherein the upper and lower safety mechanisms can be coupled together so that (i) with the upper safety mechanism in the safety-on position the lower safety mechanism is in the safety-off position or (ii) with the upper safety mechanism in the safety-off position the lower safety mechanism is in the safety-on position.

Example 12. The crossbow of any one of Examples 1 through 11 wherein the trigger mechanism can include (i) upper and lower string catches, each movable between corresponding retention and release positions and biased toward the corresponding release position, each retaining the corresponding drawn bowstring while in the corresponding retention position, and each releasing the corresponding drawn bowstring upon biased movement to the corresponding release position, (ii) upper and lower sears, each movable between corresponding firing and non-firing positions and biased toward the corresponding non-firing position, each holding the corresponding string catch in the corresponding retention position while in the corresponding non-firing position, and each permitting biased movement of the corresponding string catch to the corresponding release position upon movement to the corresponding firing position, and (iii) upper and lower trigger actuators, each movable between corresponding actuating and non-actuating positions, each linked to the corresponding sear so as to move the corresponding sear to the corresponding firing position upon movement from the corresponding non-actuated position to the corresponding actuated position.

Example 13. The crossbow of Example 12 wherein the trigger mechanism is arranged so as to enable independent actuation of each of the upper trigger actuator and the lower trigger actuator to release independently the corresponding bowstring in response to actuation of the corresponding trigger actuator.

Example 14. The crossbow of Example 12 wherein the trigger mechanism is arranged so that a single trigger actuator can act as both of the upper and lower trigger actuators, or the upper and lower trigger actuator can be coupled together to act as a single trigger actuator, and further arranged so as to enable only one of (i) release of both upper and lower bowstrings together in response to a single actuation of the single trigger actuator, (ii) release of the upper and lower bowstrings sequentially in response to a single actuation of the single trigger actuator, or (iii) release of the upper and lower bowstrings sequentially in response to two sequential actuations of the single trigger actuator.

Example 15. The crossbow of Example 12 wherein the trigger mechanism is arranged so that a single trigger actuator can act as both of the upper and lower trigger actuators, or the upper and lower trigger actuator can be coupled together to act as a single trigger actuator, and further arranged so as to enable switching among two or more of (i) an arrangement that can enable release of both upper and lower bowstrings together in response to a single actuation of the single trigger actuator, (ii) an arrangement that can enable release of the upper and lower bowstrings sequentially in response to a single actuation of the single trigger actuator, or (iii) an arrangement that can enable release of the upper and lower bowstrings sequentially in response to two sequential actuations of the single trigger actuator.

Example 16. The crossbow of any one of Examples 12 through 15 wherein the trigger mechanism is arranged so as to enable switching between (i) an arrangement that can enable independent actuation of each of the upper trigger actuator and the lower trigger actuator to release independently the corresponding bowstring in response to actuation of the corresponding trigger actuator, and (ii) an arrangement wherein the upper and lower trigger actuators can be coupled together so as to enable release of both of the upper and lower bowstrings in response to actuation of either trigger actuator.

Example 17. The crossbow of any one of Examples 1 through 16 wherein the trigger mechanism can include upper and lower anti-dry-fire mechanisms, each arranged so as to (i) prevent movement of the corresponding bowstring from the corresponding drawn position without a bolt present on the corresponding rail, and (ii) permit movement of the corresponding bowstring from the corresponding drawn position to the corresponding brace position only with a bolt present on the corresponding rail.

Example 18. The crossbow of Example 17 wherein: (a) each anti-dry-fire mechanism can include a corresponding string latch movable between a corresponding bolt-absent position and a corresponding bolt-present position and biased toward the bolt-absent position; (b) with the corresponding bowstring in the corresponding drawn position and with no bolt positioned on the corresponding rail, the corresponding string latch is held by bias force thereon in the corresponding bolt-absent position and can prevent movement of the corresponding bowstring to the corresponding brace position; and (c) with the corresponding bowstring in the corresponding drawn position and with a bolt positioned on the corresponding rail, the bolt can hold the corresponding string latch in the corresponding bolt-present position against bias force thereon and can permit movement of the corresponding bowstring to the corresponding brace position to launch the bolt positioned on the corresponding rail.

Example 19. The crossbow of any one of Examples 1 through 18 wherein the trigger mechanism can include upper and lower anti-dry-fire mechanisms, each arranged so as to (i) prevent actuation of the corresponding trigger portion of the trigger mechanism without a bolt present on the corresponding rail, and (ii) permit actuation of the corresponding trigger portion of the trigger mechanism only with a bolt present on the corresponding rail.

Example 20. The crossbow of Example 19 wherein: (a) each anti-dry-fire mechanism can include (i) a corresponding bolt sensor movable between a corresponding bolt-absent position and a corresponding bolt-present position, and (ii) a corresponding reciprocating sear latch movable between a corresponding latched position and a corresponding unlatched position and biased toward the corresponding latched position; (b) each bolt sensor is coupled to the corresponding sear latch so that (i) with the bolt sensor in the corresponding bolt-absent position, the corresponding sear latch is held in the corresponding latched position by bias force thereon, and (ii) with the bolt sensor held in the corresponding bolt present position, the corresponding sear latch is held in the corresponding unlatched position against the bias force thereon; (c) with the corresponding bowstring in the corresponding drawn position and with no bolt positioned on the corresponding rail, the corresponding bolt sensor is in the corresponding bolt-absent position, and the corresponding sear latch is held by the bias force thereon in the corresponding latched position and can prevent movement of the corresponding sear and actuation of the corresponding trigger portion; and (d) with the corresponding bowstring in the corresponding drawn position and with a bolt positioned on the corresponding rail, the corresponding bolt sensor is held in the corresponding bolt-present position, and the corresponding sear latch is held against the bias force thereon in the corresponding unlatched position and can permit movement of the corresponding sear and actuation of the corresponding trigger portion.

Example 21. The crossbow of Example 20 wherein each trigger portion can include a biased bolt retainer positioned and arranged so that, with a bolt present on the corresponding rail, the bolt retainer presses the bolt against the corresponding bolt sensor.

Example 22. The crossbow of Example 21 wherein each bolt retainer is structurally arranged to frictionally engage the corresponding bolt positioned on the corresponding rail.

Example 23. The crossbow of Example 22 wherein each bolt retainer can include an engagement surface with rounded or beveled front and back portions structurally arranged for facilitating movement of the corresponding bolt along the corresponding rail.

Example 24. The crossbow of any one of Examples 1 through 23 further comprising a mounting bracket for a sight, the mounting bracket being attached to a rearward portion of the mainframe and being movable between defined upper and lower sight positions, wherein (i) alignment of a sight mounted on the mounting bracket, with respect to a flight path of a bolt launched from the upper rail and with the mounting bracket in the upper sight position, results in equivalent alignment of the sight, with the mounting bracket in the lower sight position, with respect to a flight path of a bolt launched from the lower rail, or (ii) alignment of the mounted sight, with respect to the flight path of a bolt launched from the lower rail and with the mounting bracket in the lower sight position, results in equivalent alignment of the sight, with the mounting bracket in the upper sight position, with respect to the flight path of a bolt launched from the upper rail.

Example 25. The crossbow of any one of Examples 1 through 24 wherein at least one pair of bow limbs is arranged as a pair of recurve bow limbs.

Example 26. The crossbow of any one of Examples 1 through 25 further comprising a corresponding pulley member rotatably mounted each of at least one pair of bow limbs and engaged with a corresponding one of the bowstrings and with one or more corresponding power cables.

Example 27. The crossbow of any one of Examples 1 through 26 wherein: (a') the mainframe can further include at least one additional longitudinal rail above the upper rail that is arranged so as to support a corresponding bolt positioned thereon and to guide the corresponding bolt as the corresponding bolt is launched from the crossbow; (b') the riser can further include at least one additional longitudinal upper riser passage therethrough arranged so as to enable a bolt to be inserted through the additional riser passage, positioned on the upper or additional rail, and subsequently launched from the crossbow; (c') the crossbow can further include at least one additional pair of bow limbs attached to the riser above the upper bow limbs and at least one additional bowstring attached to the corresponding additional pair of bow limbs and arranged to (i) be drawn from a corresponding brace position to a corresponding drawn position while deforming the corresponding additional pair of bow limbs and (ii) return to the corresponding brace position and thereby launch a bolt positioned on the corresponding additional rail, the upper bowstring being movable within a longitudinal slot between the additional and upper rails; and (d') the trigger mechanism can be further arranged so as to retain the additional bowstring in the corresponding drawn position and release, upon actuation by a user, the additional bowstring to return to the corresponding brace position.

Example 28. A trigger mechanism for a crossbow, the trigger mechanism comprising: (a) a string catch movable retention and release positions and biased toward the release position, the string catch being arranged so as to (i) retain a drawn bowstring of the crossbow while in the corresponding retention position, and (ii) release the drawn bowstring upon biased movement to the release position; (b) a sear movable between firing and non-firing positions and biased toward the corresponding non-firing position, the sear being arranged so as to hold the string catch in the retention position while in the non-firing position, and to permit biased movement of the string catch to the release position upon movement to the firing position; (c) a trigger actuator movable between corresponding actuating and non-actuating positions, the trigger actuator being linked to the sear so as to move the sear to the firing position upon movement from the non-actuated position to the actuated position; and (d) an anti-dry-fire mechanism arranged so as to (i) prevent movement of the trigger actuator to the actuated position without a bolt present on a rail of the crossbow, and (ii) permit movement of the trigger actuator to the actuated position only with a bolt present on the rail, wherein: (e) the anti-dry-fire mechanism can include (i) a bolt sensor movable between a bolt-absent position and a bolt-present position, and (ii) a reciprocating sear latch movable between a latched position and an unlatched position and biased toward the latched position; (f) the bolt sensor can be coupled to the sear latch so that (i) with the bolt sensor in the bolt-absent position, the sear latch can be held in the latched position by bias force thereon, and (ii) with the bolt sensor held in the bolt present position, the sear latch can be held in the unlatched position against the bias force thereon; (g) with the drawn bowstring retained by the string catch and with no bolt positioned on the rail, the bolt sensor can be in the bolt-absent position, and the sear latch can be held by the bias force thereon in the latched position and can prevent movement of the sear and movement of the trigger actuator to the actuated position; and (h) with the draw bowstring retained by the string catch and with a bolt positioned on the rail, the bolt sensor can be held in the bolt-present position, and the sear latch can be held against the bias force thereon in the unlatched position and can permit movement of the sear and movement of the trigger actuator to the actuated position.

Example 29. The trigger mechanism of Example 28 wherein the trigger mechanism can include a biased bolt retainer positioned and arranged so that, with a bolt present on the rail, the bolt retainer presses the bolt against the bolt sensor.

Example 30. The crossbow of Example 29 wherein the bolt retainer can be structurally arranged to frictionally engage the bolt positioned on the rail.

Example 31. The crossbow of Example 30 wherein the bolt retainer can include an engagement surface with rounded or beveled front and back portions structurally arranged for facilitating movement of the bolt along the rail.

Example 32. The trigger mechanism of any one of Examples 28 through 31 further comprising a safety mechanism movable between (i) a safety-on position that can prevent actuation of the trigger mechanism and (ii) a safety-off position that allows actuation of the trigger mechanism.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Therefore the present disclosure shall be construed as implicitly disclosing any embodiment having any suitable subset of one or more features—which features are shown, described, or claimed in the present application—including those subsets that may not be explicitly disclosed herein. A "suitable" subset of features can include only features that are neither incompatible nor mutually exclusive with respect to any other feature of that subset. Accordingly, the appended claims are hereby incorporated into the Detailed Description, with each claim standing on its own as a separate disclosed embodiment. In addition, each of the appended dependent claims shall be interpreted, only for purposes of disclosure by said incorporation of the claims into the Detailed Description, as if written in multiple dependent form and dependent upon all preceding claims with which it is not inconsistent. It should be further noted that the cumulative scope of the appended claims can, but does not necessarily, encompass the whole of the subject matter disclosed in the present application.

The following interpretations shall apply for purposes of the present disclosure and appended claims. The words "comprising," "including," "having," and variants thereof, wherever they appear, shall be construed as open-ended terminology, with the same meaning as if a phrase such as "at least" were appended after each instance thereof, unless explicitly stated otherwise. The article "a" shall be interpreted as "one or more" unless "only one," "a single," or other similar limitation is stated explicitly or is implicit in the particular context; similarly, the article "the" shall be interpreted as "one or more of the" unless "only one of the," "a single one of the," or other similar limitation is stated explicitly or is implicit in the particular context. The conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. Similarly, "one or more of a dog or a cat" would be interpreted as including (i) one or more dogs without any cats, (ii) one or more cats without any dogs, or (iii) one or more dogs and one or more cats, unless explicitly stated otherwise or the alternatives are understood or disclosed (implicitly or explicitly) to be mutually exclusive or incompatible. Similarly, "one or more of a dog, a cat, or a mouse" would be interpreted as (i) one or more dogs without any cats or mice, (ii) one or more cats without and dogs or mice, (iii) one or more mice without any dogs or cats, (iv) one or more dogs and one or more cats without any mice, (v) one or more dogs and one or more mice without any cats, (vi) one or more cats and one or more mice without any dogs, or (vii) one or more dogs, one or more cats, and one or more mice. "Two or more of a dog, a cat, or a mouse" would be interpreted as (i) one or more dogs and one or more cats without any mice, (ii) one or more dogs and one or more mice without any cats, (iii) one or more cats and one or more mice without and dogs, or (iv) one or more dogs, one or more cats, and one or more mice; "three or more," "four or more," and so on would be analogously interpreted. For any of the preceding recitations, if any pairs or combinations of the included alternatives are understood or disclosed (implicitly or explicitly) to be incompatible or mutually exclusive, such pairs or combinations are understood to be excluded from the corresponding recitation.

For purposes of the present disclosure or appended claims, when terms are employed such as "about equal to,"

"substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, third, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A crossbow and projectile system, the system comprising:

a crossbow including a trigger mechanism having a biased projectile retainer, the biased projectile retainer comprising:

a detent mechanism; and a biasing member for providing a biasing force against the detent mechanism;

a projectile comprising:

a shaft; and a nock at least partially extending from the shaft, the nock including at least one radial indention defined therein;

wherein the detent mechanism is configured to engage the radial indention of the nock to retain the projectile in a position relative to at least one of the trigger mechanism and a bowstring.

2. The system of claim 1, wherein the projectile is at least one of an archery arrow and an archery bolt.

3. The system of claim 1, wherein the detent mechanism is adapted for being at least partially received within the radial indention of the nock.

4. The system of claim 1, wherein a width of the detent mechanism generally corresponds to a width of the radial indention of the nock.

5. The system of claim 1, wherein the detent mechanism is at least one of a spherical ball, a cylindrical pin, and a plunger.

6. The system of claim 1, wherein the biasing member is a spring.

7. The system of claim 1, wherein the detent mechanism is biased toward a bolt-absent position.

8. The system of claim 7, wherein when a bolt is positioned on a rail of the crossbow, the detent mechanism is forced into a bolt-present position.

9. The system of claim 1, wherein the nock defines a longitudinal axis, and wherein a rearward segment of the nock defines a rearward bearing planar surface that is generally perpendicular to the longitudinal axis.

10. The system of claim 1, wherein the at least one radial indention is a groove defined generally continuously around a circumference of the nock.

11. The system of claim 1, wherein the at least one radial indention comprises a plurality of grooves defined generally intermittently around a circumference of the nock.

12. A crossbow comprising:

a trigger mechanism including:

a housing;

a trigger; and a biased projectile retainer, the biased projectile retainer including:

a detent mechanism; and a biasing member for providing a biasing force against the detent mechanism;

wherein the detent mechanism is configured to engage a radial indention defined in a nock to retain a projectile in a position relative to at least one of the trigger mechanism and a bowstring.

13. The crossbow of claim 12, wherein the detent mechanism is adapted for being at least partially received within the radial indention of the nock.

14. The crossbow of claim 12, wherein the detent mechanism is at least one of a spherical ball, a cylindrical pin, and a plunger.

15. The crossbow of claim 12, wherein the biasing member is a spring.

16. The crossbow of claim 12, wherein the detent mechanism is biased toward a bolt-absent position.

17. The crossbow of claim 16, wherein when a bolt is positioned on a rail of the crossbow, the detent mechanism is forced into a bolt-present position.

18. A trigger mechanism for a crossbow, the trigger mechanism comprising:

a housing;

a trigger; and a biased projectile retainer, the biased projectile retainer including:

a detent mechanism; and a biasing member for providing a biasing force against the detent mechanism;

wherein the detent mechanism is configured to engage a radial indention defined in a nock to retain a projectile in a position relative to at least one of the trigger mechanism and a bowstring.

* * * * *